US005957310A

United States Patent [19]

Mitchell

[11] Patent Number: 5,957,310

[45] Date of Patent: Sep. 28, 1999

[54] TENSILELY STRESSED STORAGE FURNITURE

[76] Inventor: Peter B. Mitchell, Oneida Dr., P.O. Box 2535, Silver Bay, N.Y. 12874

[21] Appl. No.: 08/540,659

[22] Filed: Oct. 11, 1995

[51] Int. Cl.[6] ..... A47F 7/00

[52] U.S. Cl. ..... 211/186; 211/149

[58] Field of Search ..... 211/186, 189, 211/149, 195

[56] References Cited

U.S. PATENT DOCUMENTS

| | | | |
|---|---|---|---|
| 1,394,007 | 10/1921 | Hall | 312/3 |
| 2,305,279 | 12/1942 | Smith | 206/44 |
| 2,517,757 | 12/1950 | Adlerstein | 312/3 |
| 3,519,318 | 7/1970 | Hagen | 312/245 |
| 3,967,327 | 7/1976 | Severson | 211/149 |
| 4,270,816 | 6/1981 | Ericksen et al. | 312/3 |
| 4,382,640 | 5/1983 | Kashden | 312/5 |
| 4,582,003 | 4/1986 | Valero | 211/195 |
| 4,664,266 | 5/1987 | Fausett et al. | 211/87 |
| 4,949,851 | 8/1990 | Shaffer | 211/149 |
| 5,257,701 | 11/1993 | Edelson | 211/149 |
| 5,632,390 | 5/1997 | Podergois | 211/149 |

*Primary Examiner*—Alvin C. Chin-Shue
*Assistant Examiner*—Sarah Purol

[57] ABSTRACT

Storage furniture comprising a rigid, largely external structural framework and a compatibly shaped storage system, suspended within, comprising a plurality of panels that are flexible, tensilely strong, substantially inelastic and adjustably, tensilely stressed in at least two largely perpendicular directions to achieve "near-rigid" storage surfaces. Storage system further being flexibly reinforced, intrapanelly and extrapanelly, to maximize panel rigidity and load-bearing capacity.

52 Claims, 10 Drawing Sheets

FIG. 42
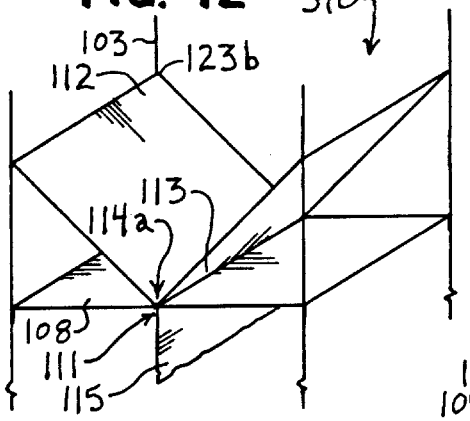
FIG. 43
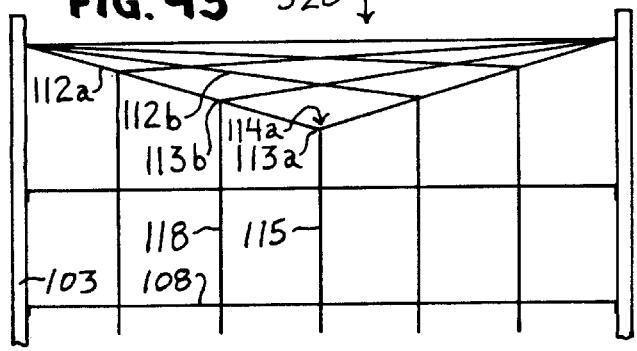
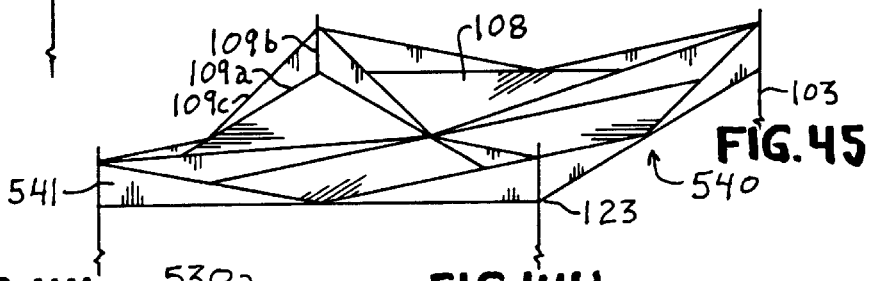
FIG. 45
FIG. 44a
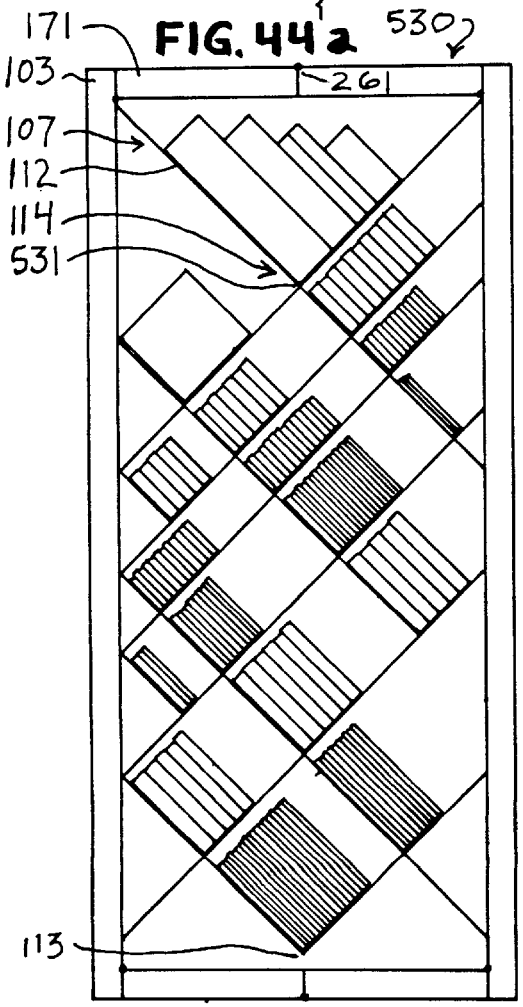
FIG. 44b
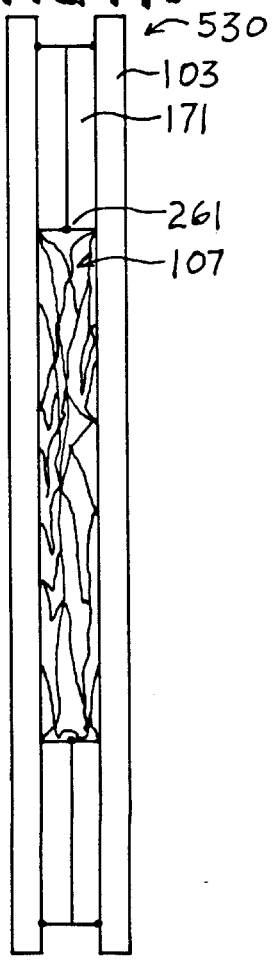

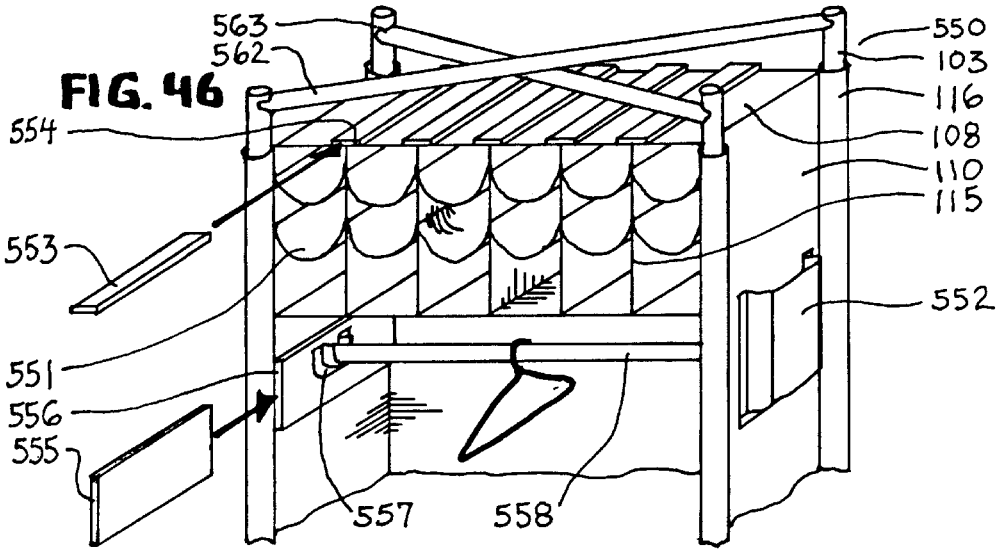
FIG. 46
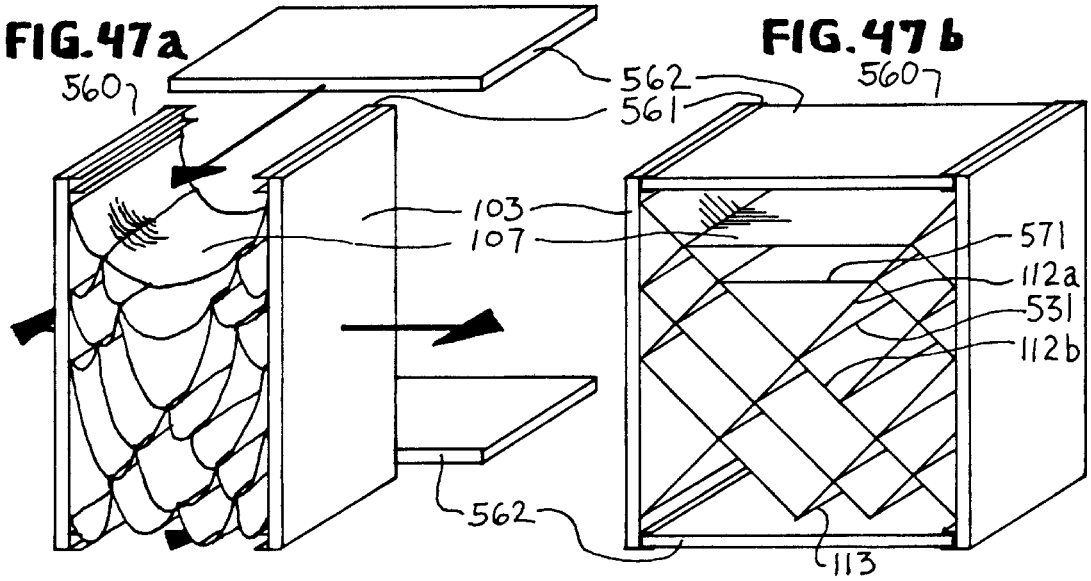
FIG. 47a
FIG. 47b
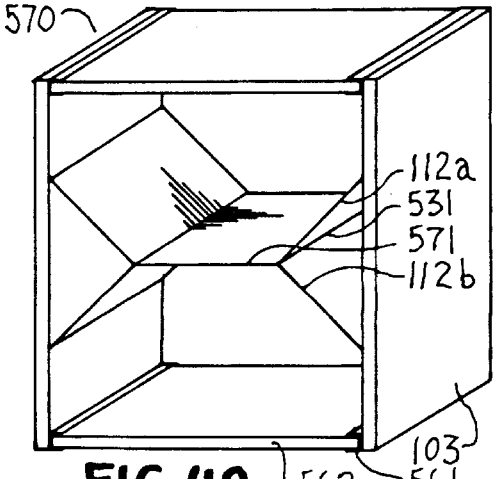
FIG. 48
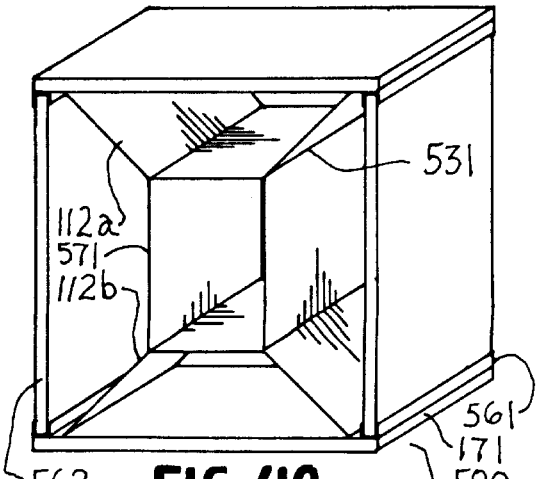
FIG. 49

TENSILELY STRESSED STORAGE FURNITURE

BACKGROUND

1. Field of the Invention

The present invention broadly relates to furniture designed for shelf storage of both hard and soft goods of varying weight. In particular, this invention focuses on furniture incorporating flexible panels tensilely stressed as structural elements for the purpose of creating lightweight storage furniture that dramatically improves strength-to-weight performance ratios while reducing the cost of manufacture and distribution.

2. Prior Art

There is abundant history of the use of fabric panels as structural elements in casual furniture, including items like hammocks, director's chairs, and pool-deck chaise lounges that demonstrate the considerable strength of fabric panels. Being designed to support humans, the fabric panels of this type of furniture are largely unstressed in order to provide a gradual curved, comfortable support surface. This is traditionally accomplished by suspending either somewhat elastic material or slackened inelastic material between rigid support members. While practical for supporting an individual, this kind of support surface is inappropriate for the organized storage of multiple items, animate or inanimate, because unstressed panels have the inherent problem of panel sag under loading conditions when objects tend to slip towards the center. This slippage causes congestion, inefficient weight distribution and compromised capacity.

Efforts to create a more planar-like storage surface with flexible panels has had mixed results. Much of the prior art resorts to some form of rigid insert in combination with one or more fabric panels, as typified by U.S. Pat. No. 3,519,318, which describes "flat shelf boards co-extensive with and supported by the cross canvas strips." Although rigidity can be achieved in this manner, the practice tends to be undesirable for two reasons: 1) the cost-ineffectiveness of including two components that separately could each perform the storage surface function and 2) the extra weight burden of any unnecessary stiffening material.

In a different approach, Erikson et al. teach in U.S. Pat. No. 4,270,816 that deflection of the fabric plane can be minimized by tensilely stressing the fabric panel in one direction. However, actual usage based on this prior art reveals two inherent problems. First, stressing panels in only one direction severely compromises the fabric's overall tensile strength capacity. In the typical cross-weave fabric as illustrated in U.S. Pat. No. 4,270, 816, fibers in the stressed direction are directly burdened with dynamic loads, while the remaining perpendicular fibers carry little of the load stress. Even with non-woven fabrics, tensile strength capacity is significantly underutilized. As a result, the one-way stressed fabric panels experience significant deflection under everything but light dynamic loads unless rigid inserts are incorporated. Indeed, Erikson et al. admit "additional rods may be provided beneath the shelves for support or to lend structural rigidity." The second inherent problem concerns prestressing the fabric panels by a single, pre-determined dimension with no apparent means of adjusting the level of tensile stress to properly accommodate varying load factors or residual elasticity upon subsequent load applications.

OBJECTS OF THE INVENTION

The overall object of the present invention is to provide improved storage furniture that:

1. Maximizes use of lighter weight, flexible material for storage surfaces with minimal use of heavier rigid supports, while still achieving near-rigid planar surfaces and sturdy construction.
   a) Lighter weight furniture improves portability as well as reduces shipping and handling costs.
   b) Flexible panels allow more compactability in knock-down or pre-assembled state for lower warehousing and distribution costs.
   c) Traditional furniture relies on rigid components like hardwoods and particleboards, which are frequently in short supply and significantly more expensive.
   d) Lighter weight, less costly and less bulky panel components allow greater usage for superior compartmentalization storage features.
2. Minimizes panel sag by adjustably stressing panels in at least two largely perpendicular directions.
   a) This capitalizes on the panel's full tensile strength capacity, versus unstressed or one-way stressed panels.
   b) This provides "near-rigidity" of storage panels for a more desirable, flatter storage surface.
   c) The adjustability feature accommodates varying fabric elasticities, varying anticipated dynamic loads as well as residual panel elasticity over time.
3. Maximizes the load-bearing capacity of panels, without rigid inserts, by using stressed fibers and panels as structural components to redistribute loads and reinforce panels.
   a) This achieves a more even load balance throughout the furniture.
   b) This maximizes the furniture's overall strength-to-weight ratio (i.e. storage weight capacity vs. unit's static weight).

The present invention achieves these objects with extraordinary results by uniquely combining a rigid, largely external structural framework with a compatibly shaped storage system that is suspended largely within and composed of flexible panels tensilely and adjustably stressed in at least two largely perpendicular directions. The invention establishes five distinct methods of achieving this multi-directional panel stressing, namely by: 1. framework dimensional expansion, 2. engagement contraction, 3. gravity-induced stressing, 4. panel shrinking and 5. panel pre-stressing or by various combinations of these five stressing methods. Additionally, this invention establishes several embodiments of the flexible storage system designed to increase both the load-bearing capacity and rigidity of panels without the use of rigid insert components. Briefly, this is achieved by employing different configurations of stressed, reinforcing fibers and panels, both intrapanelly and extrapanelly, to effectively redistribute static and dynamic stresses from lesser to greater load-bearing points.

Prototype models incorporating the principles established in this invention are remarkably strong, lightweight and achieve strength-to-weight ratios in excess of 10:1, versus more traditional storage furniture averaging 1:1 ratios. These and other objects and advantages of the invention will be more fully understood with reference to the following drawings and detailed description.

BRIEF DESCRIPTION OF THE DRAWINGS

Figure 1:
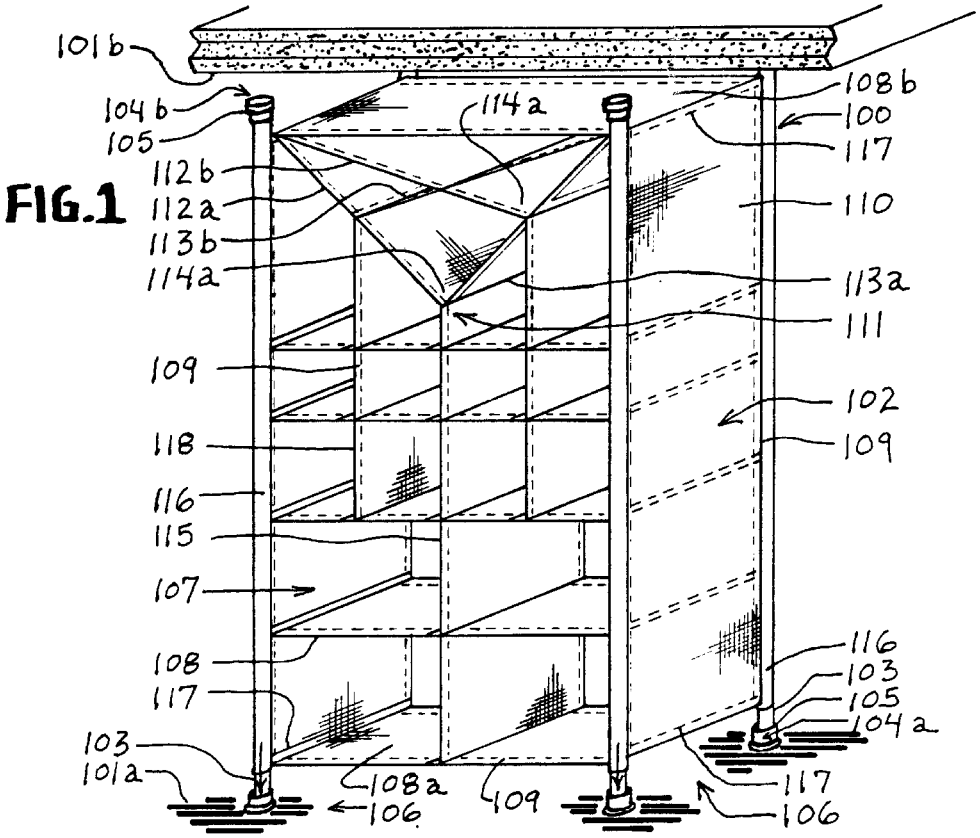
Figure 2:
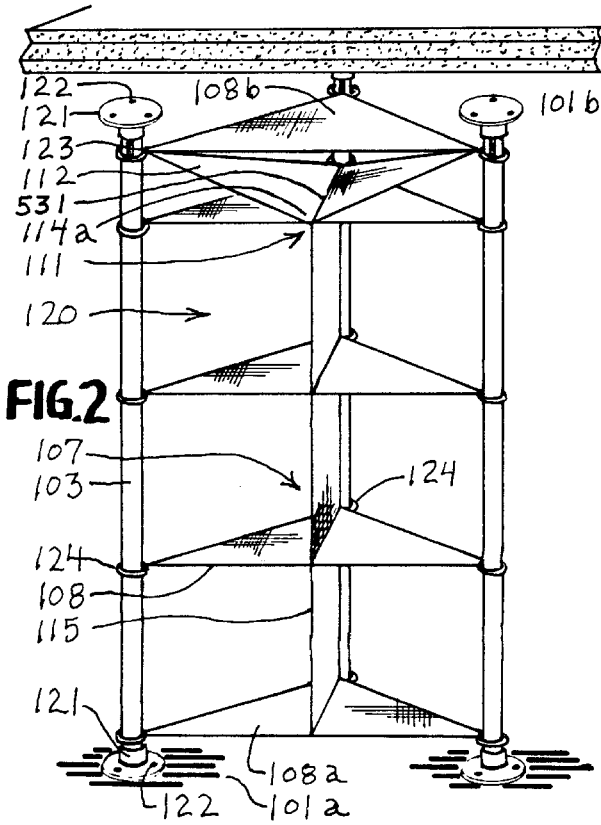

| FIGURE | EMBODIMENT | TYPE VIEW* | FIGURE DESCRIPTION |
|---|---|---|---|
| FIG. 1 | 1st EMB | eg. 1 perspective view | Floor-to-Ceiling Storage Chest 100 |
| FIG. 2 | | eg. 2 perspective view | Floor-to-Ceiling Triang. Unit 120 |
| FIG. 3 | | eg. 3 perspective view | Structural Template Unit 130 |
| FIG. 4 | 2nd EMB | eg. 1 fragmental persp. | Channel-Guided Unit 140 |
| FIG. 5 | | eg. 2 enlarged frag. persp. | Track-Guided Unit 150 |
| FIG. 6 | | eg. 3 top plan view | Edge-Guided Unit 160 |
| FIG. 7 | | eg. 4 fragmental persp. | Corner-Guided Unit 170 |
| FIG. 8 | 3rd EMB | eg. 1 fragmental persp. | Elongating Diagonals Unit 180 |
| FIG. 9 | | eg. 2 fragmental persp. | Elongating Perimeter Unit 190 |
| FIG. 10 | | eg. 3 fragmental persp. | Elongating Circular Unit 200 |
| FIG. 11 | | eg. 4 perspective views | Elongating Pyramid Unit 210 |
| FIG. 12 | | eg. 5 perspective view | Elongating Sloped Diag. Unit 220 |
| FIG. 13 | | eg. 6 perspective view | Elongating 3-way Elbow Unit 230 |
| FIG. 14 | 4th EMB | eg. 1 perspective view | Concave Bow Spring Unit 240 |
| FIG. 15 | | eg. 2 perspective view | 3-way Spring Elbow Unit 250 |
| FIG. 16 | 5th EMB | eg. 1 fragmental persp. | Bi-Folding Diagonal Unit 260 |
| FIG. 17 | | eg. 2 fragmental persp. | Spoke Radial Unit 270 |
| FIG. 18 | | eg. 3 fragmental persp. | Folding Horizontals Unit 280 |
| FIG. 19 | | eg. 4 perspective view | In-Fold Verticals Unit 290 |
| FIG. 20 | | eg. 5 enlarged frag. persp. | Retractable Corners Unit 300 |
| FIG. 21 | | eg. 6 top plan view | Bi-Fold Verticals Unit 310 |
| FIG. 22 | 6th EMB | eg. 1 perspective view | Spreading Pyramid Unit 320 |
| FIG. 23 | | eg. 2 perspective view | Spreading Flared Leg Unit 330 |
| FIG. 24 | 7th EMB | eg. 1 perspective view | Out-fold Verticals Unit 340 |
| FIG. 25 | | eg. 2 perspective view | Wedge Base Unit 345 |
| FIG. 26 | | eg. 3 perspective view | Vertical Cylindrical Unit 350 |
| FIG. 27 | | eg. 4 perspective views | Telescoping Pyramid Unit 360 |
| FIG. 28 | | eg. 5 top plan view | Outswing Corner Unit 370 |
| FIG. 29 | 8th EMB | eg. 1 top plan view | Roller Reefing Frame 380 |
| FIG. 30 | | eg. 2 enlarged sect. view | Draw Latch Engagement 390 |
| FIG. 31 | | eg. 3 enlarged frag. persp. | Reinforced Panel Corner 400 |
| FIG. 32 | 9th EMB | eg. 1 perspective view | Gravity Stressing Frustum Unit 405 |
| FIG. 33 | 12th EMB | eg. 1 perspective view | Side Placement Unit 410 |
| FIG. 34 | | eg. 2 perspective view | Elongating Cantilevered Unit 420 |
| FIG. 35 | | eg. 3 perspective view | Pivoting X-Frame 430 |
| FIG. 36 | | eg. 4 top plan views | Hinged Wall Unit 440 |
| FIG. 37 | | eg. 5 perspective view | Telescoping Standard Unit 450 |
| FIG. 38 | 13th EMB | eg.1 top plan view | Fixed Network Rectang. Shelf 460 |
| FIG. 39 | | eg. 2 top plan view | Fixed Network Triangular Shelf 470 |
| FIG. 40 | | eg. 3 front elev. view | Stabilized Network Vert. Panel 480 |
| FIG. 41 | 14th EMB | eg. 1 perspective view | Center-Supported Pyramid 500 |
| FIG. 42 | | eg. 2 fragmental persp. | V-suspended System 510 |
| FIG. 43 | | eg. 3 part. front elev. | Wide Span System 520 |
| FIG. 44 | | eg. 4 front elev. view | Sloped Library Unit 530 |
| FIG. 45 | | eg. 5 fragmental persp. | Suspension Braced Unit 540 |
| FIG. 46 | 1st. EMB | eg. 4 fragmental persp. | Hybrid Storage System 550 |
| FIGS. 47a, 47b | 1st. EMB | eg. 5 perspective view | Insertion Spreader Frame 560 |
| FIG. 48 | 14th EMB | eg. 6 perspective view | Sloped Storage System 570 |
| FIG. 49 | 14th EMB | eg. 7 perspective view | Vertical Strut Frame 580 |

*All perspective views are of the isometric type.

Figure 3:
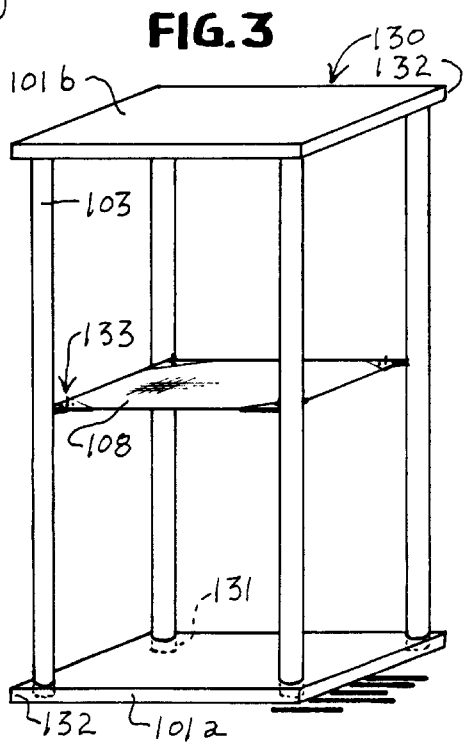

FIGS. 1 to 28, 46 and 47 illustrate numerous embodiments of the present storage furniture invention that feature expanding frameworks as a method of generating tensile stress to storage panels. FIGS. 1 to 3, 46 and 47 are isometric perspectives of the first emodiment, namely direct placement methods of framework expansion. FIG. 1 shows a floor-to-ceiling right rectangular prism-shaped storage chest including a planar Y-network. FIG. 2 shows a triangular version of a similar chest as FIG. 1. FIG. 3 shows a free-standing chest featuring rigid template bases and a simplified storage system. FIG. 46 shows a fragmental perspective of a chest featuring diagonal rigid struts and a hybrid storage system. FIG. 47 shows another free-standing chest with a channeled horizontal insert strut.

Figure 4:
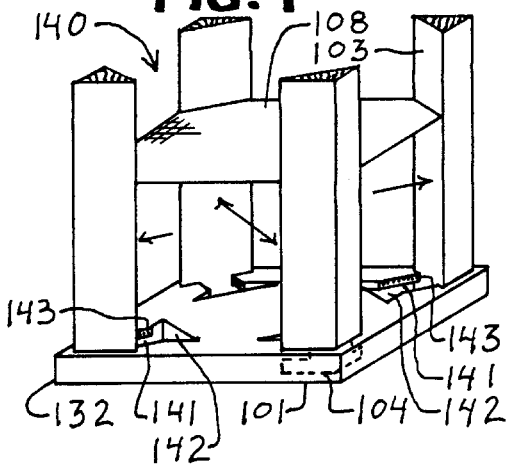
Figure 5:
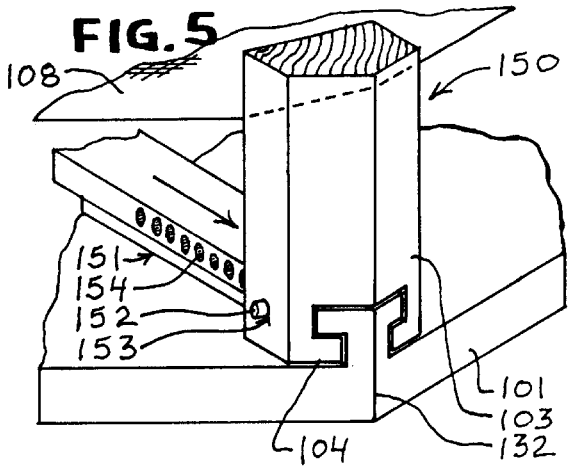
Figure 6:
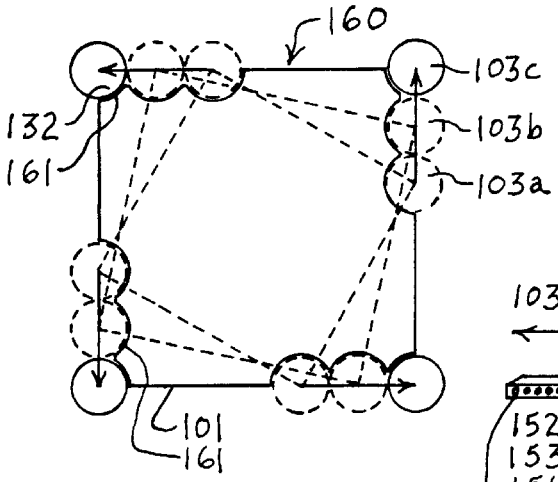
Figure 7:
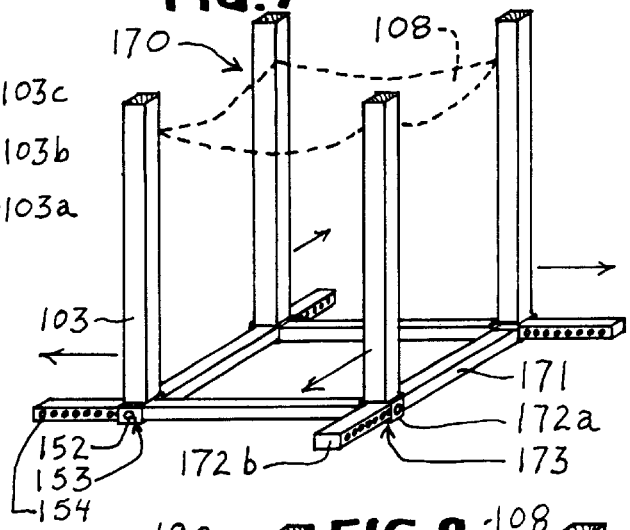

FIGS. 4 to 7 illustrate the second embodiment, namely directional guiding methods of framework expansion. FIG. 4 is a fragmental isometric perspective of a unit featuring channeled bases. FIG. 5 is an enlarged fragmental isometric perspective of a raised track base. FIG. 6 is a top plan view of an edge-quiding base. FIG. 7 is a fragmental perspective of an expanding corner-guided base.

Figure 8:
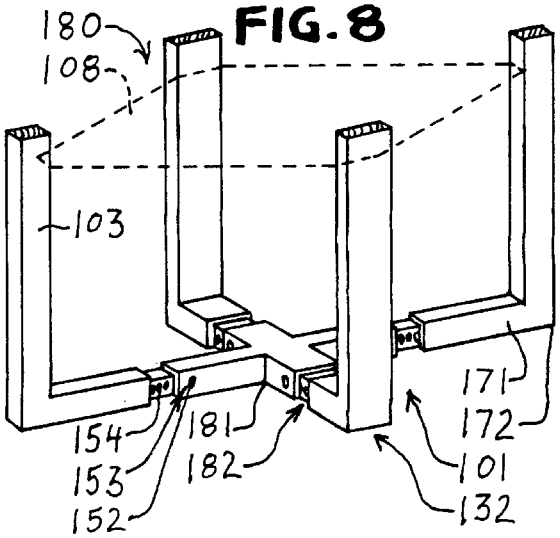
Figure 9:
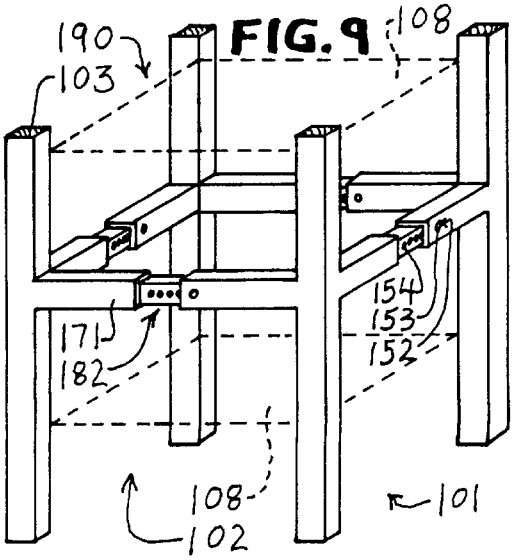
Figure 10:
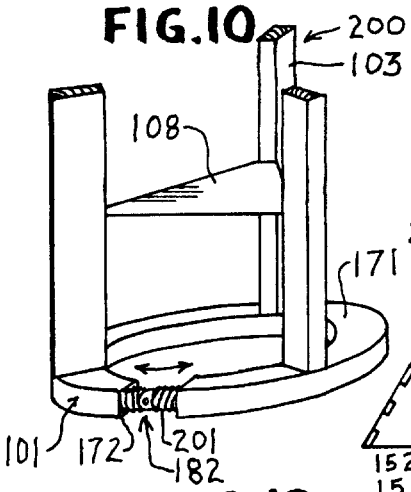
Figure 11A:
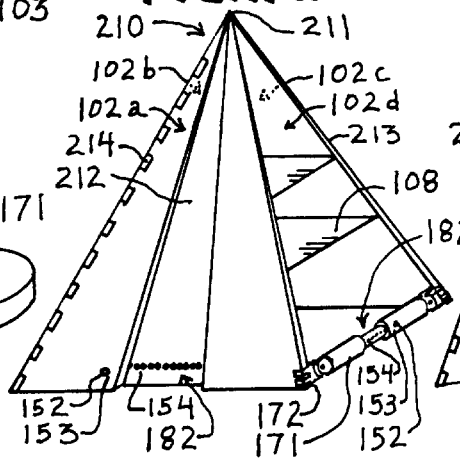
Figure 11B:
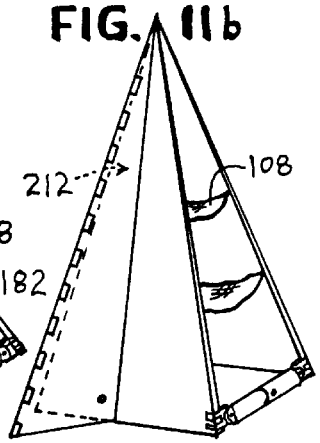
Figure 12:
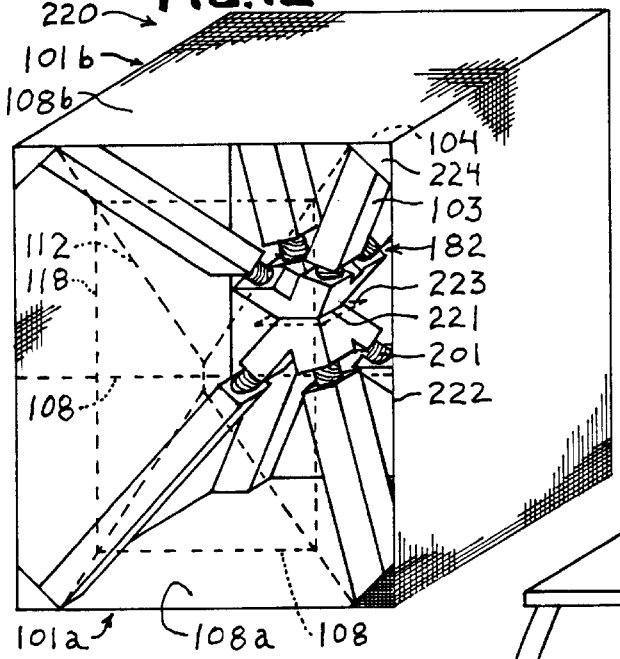
Figure 13:
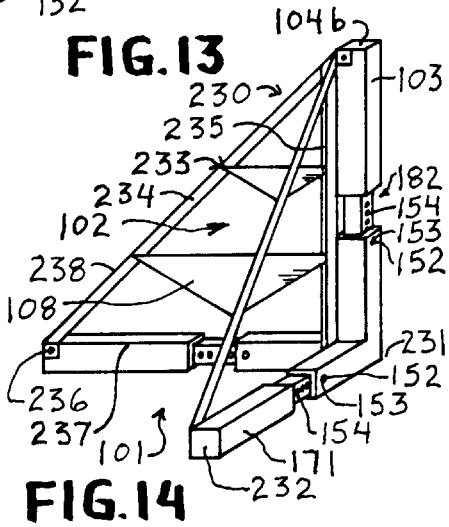

FIGS. 8 to 13 are isometric perspectives of the third embodiment namely elongation methods of framework expansion. FIG. 8 shows a unit's base with elongating diagonal members. FIG. 9 is a fragmental view of a frame with elongating horizontal spreaders. FIG. 10 features a unit with elongating circular bases. FIGS. 11*a* and 11*b* show a horizontally elongating pyramid-shaped unit in expanded and contracted modes, respectively. FIG. 12 shows a unit with elongating interior sloped diagonals. FIG. 13 shows a tetrahedron-shaped unit featuring an elongating 3-way elbow frame.

Figure 14:
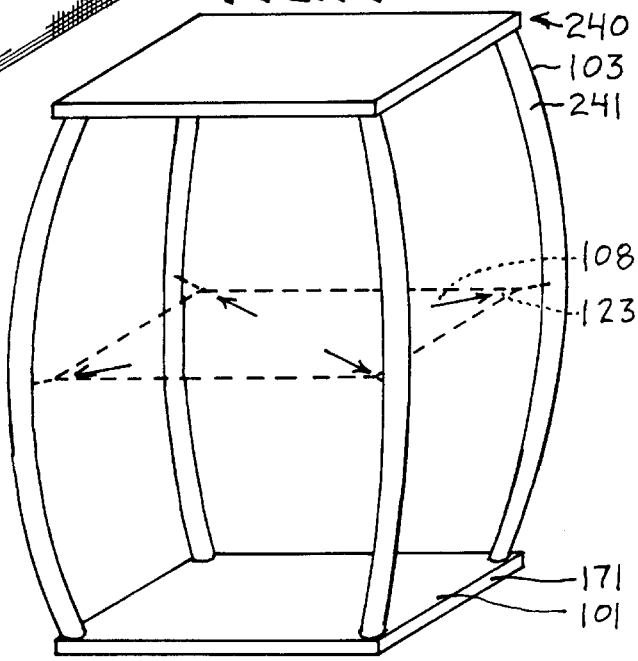
Figure 15:
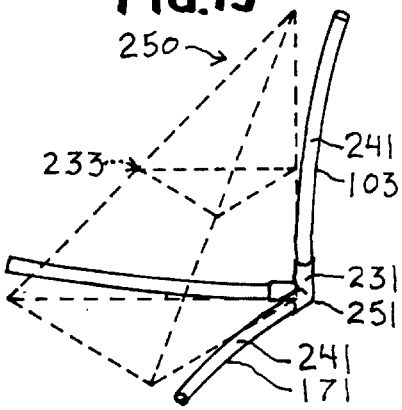

FIGS. 14 and 15 are isometric perspectives of the fourth embodiment, namely spring mechanisms that achieve framework expansion. FIG. 14 shows a unit with concave bow spring verticals. FIG. 15 shows a tetrahedron-shaped unit illustrating convex bow support members.

Figure 16:
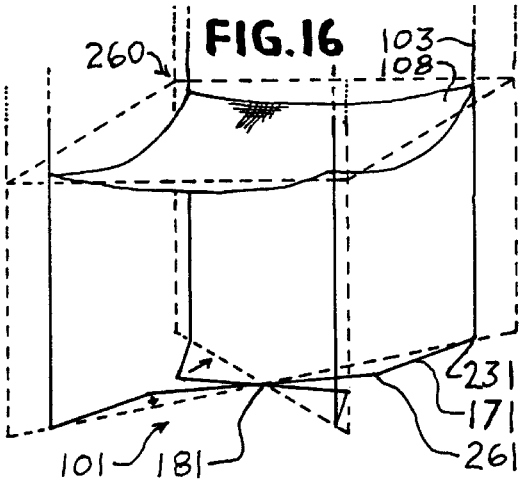
Figure 17:
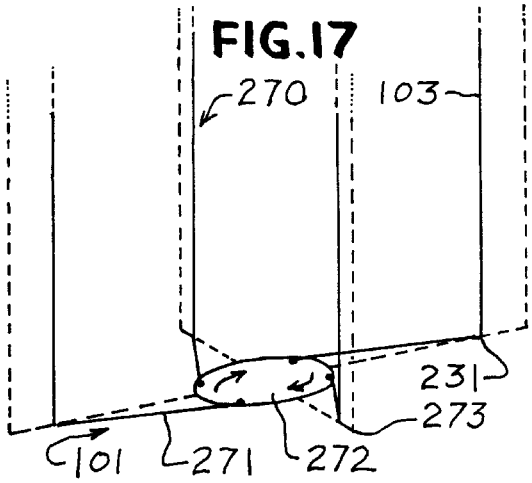
Figure 18:
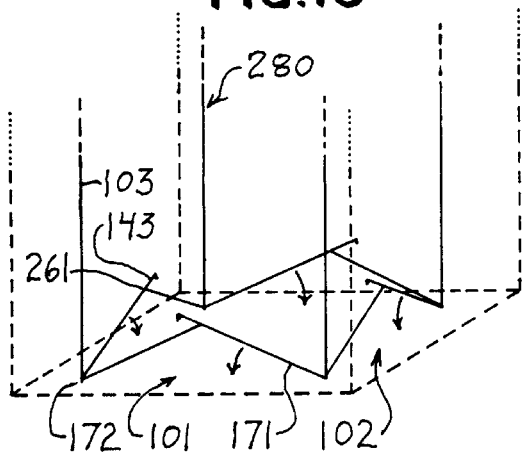
Figure 19:
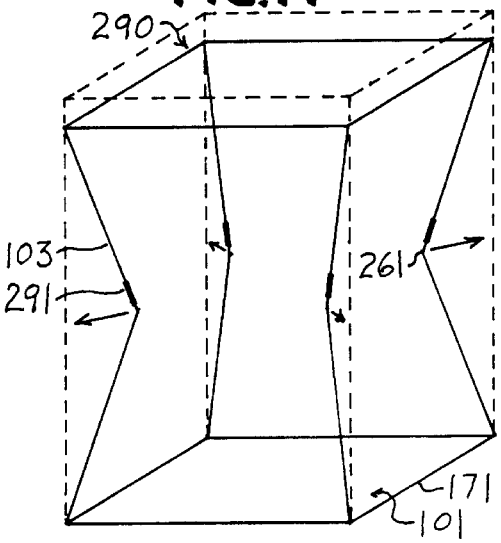
Figure 20:
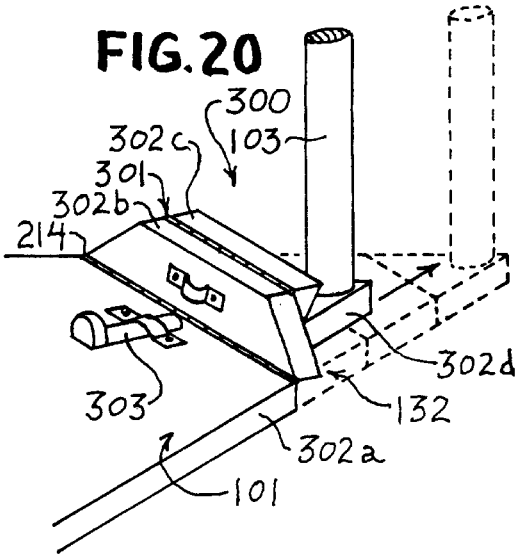
Figure 21:
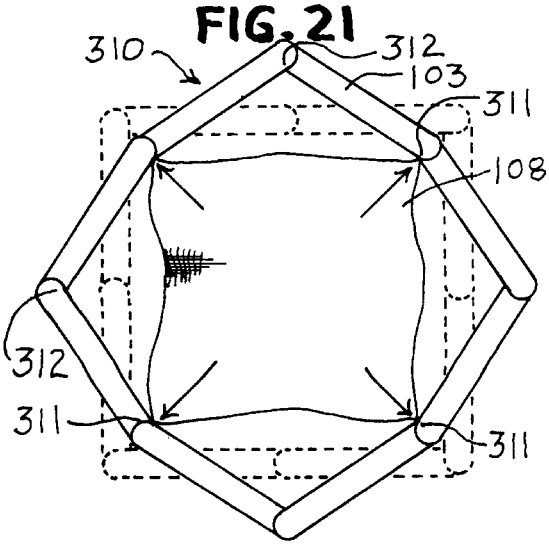

FIGS. 16 to 21 are isometric perspectives of the fifth embodiment, namely folding methods of framework expansion. FIG. 16 is a fragmental view featuring a folding diagonal base. FIG. 17 is a fragmental view featuring a rotating spoke radial base. FIG. 18 is a fragmental view of a fully collapsible unit featuring folding horizontal members. FIG. 19 shows a unit with in-fold verticals. FIG. 20 is an enlarged fragmental view of a unit's base featuring folding retractable corners. FIG. 21 is a top plan view of a unit featuring bi-folding vertical side panels.

Figure 22:
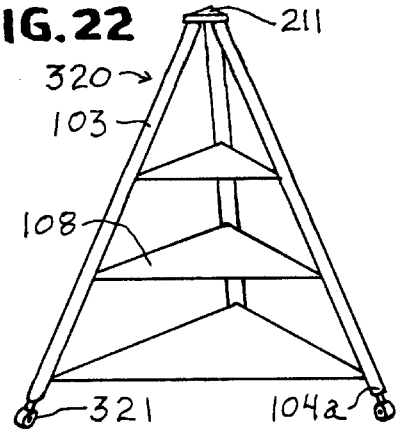
Figure 23:
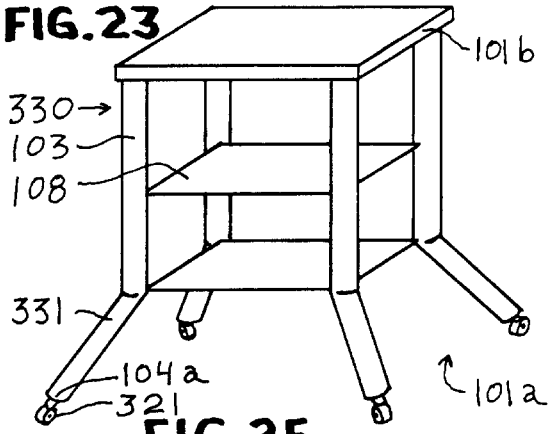

FIGS. 22 and 23 are isometric perspectives of the sixth embodiment, namely gravity spreading methods of framework expansion. FIG. 22 shows a pyramid-shaped unit. FIG. 23 shows a right rectangular prism-shaped unit featuring flared legs.

Figure 24:
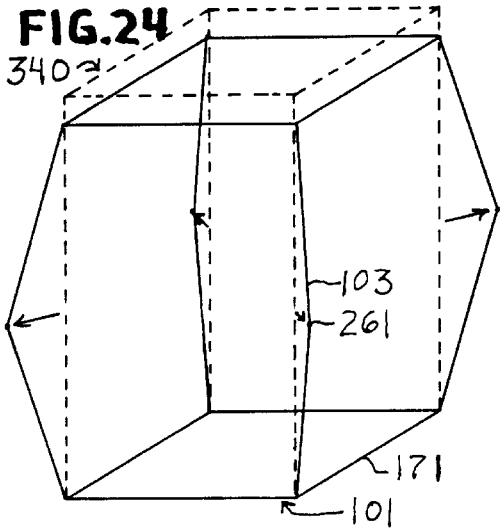
Figure 25:
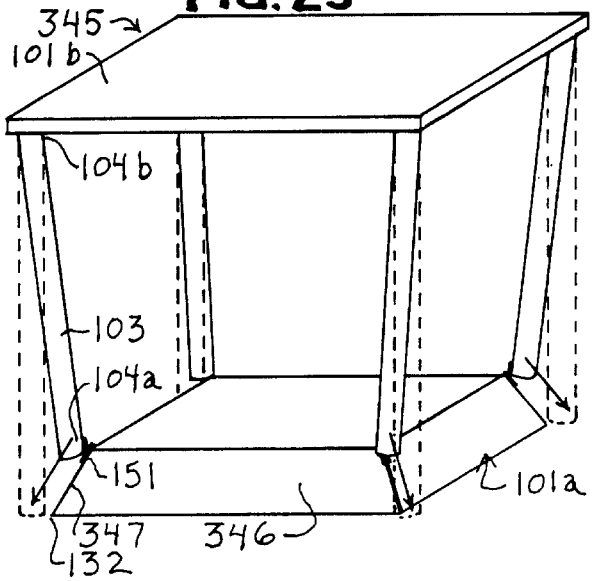
Figure 26:
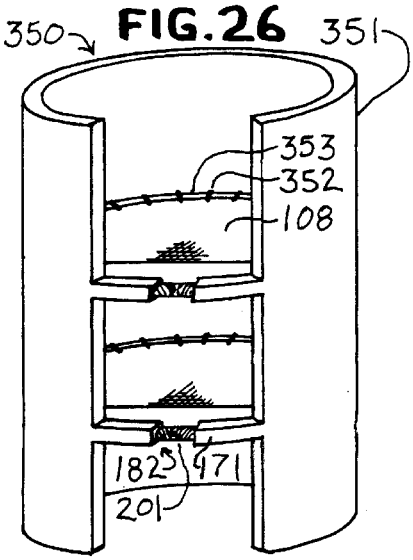
Figure 27A:
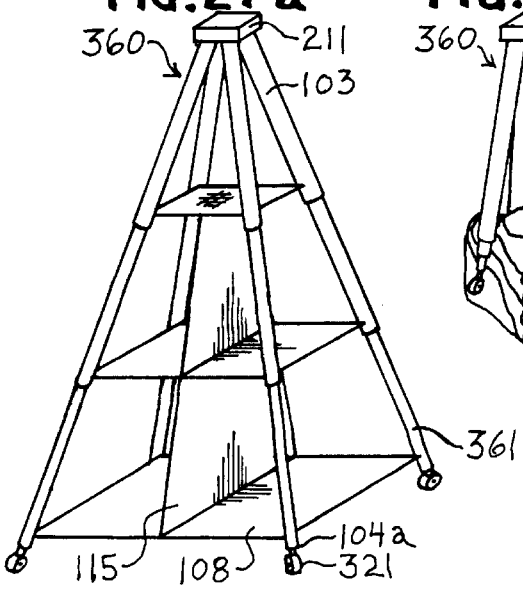
Figure 27B:
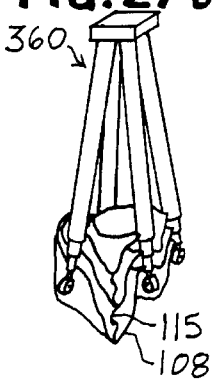
Figure 28:
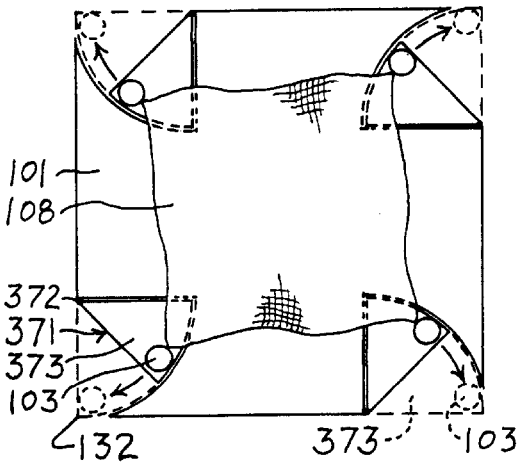

FIGS. 24 to 28 are mostly isometric perspectives of the seventh embodiment, namely combined methods of framework expansion. FIG. 24 shows a unit with gravity-induced out-folding verticals. FIG. 25 shows a wedge-based unit. FIG. 26 is a cylindrical-shaped unit. FIGS. 27*a* and 27*b* show a telescoping pyramid unit in expanded and contracted states, respectively. FIG. 28 is a top plan view of a unit featuring corner out-swing movement.

Figure 29:
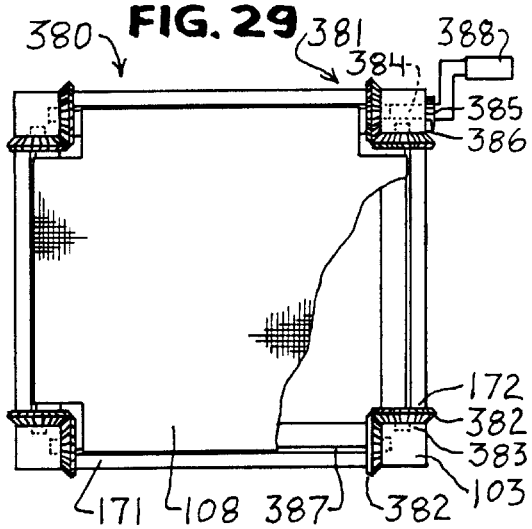
Figure 30:
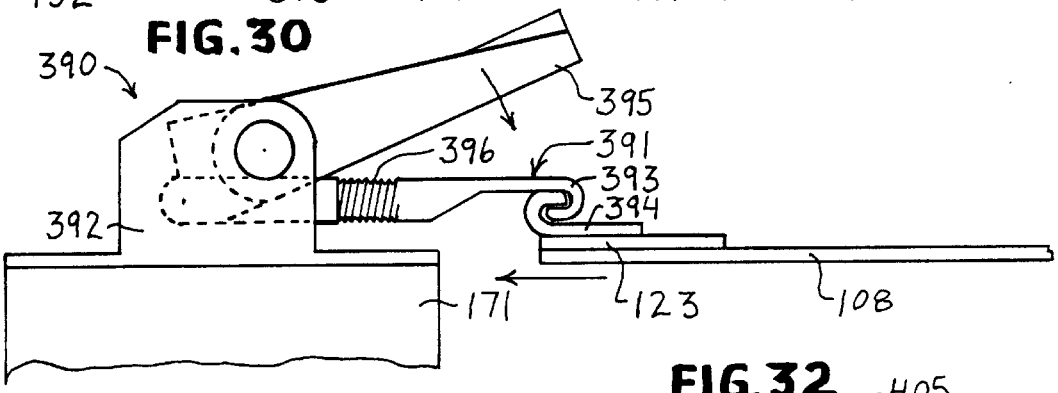
Figure 31:
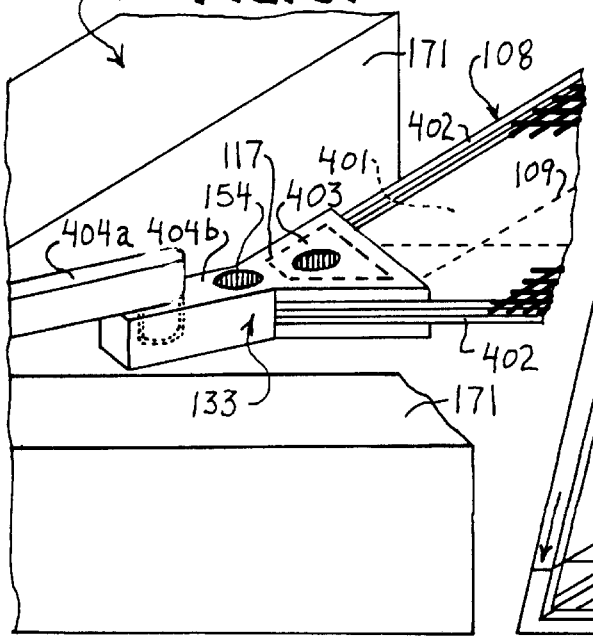

FIGS. 29 to 31 illustrate the eighth embodiment of this invention, an alternative approach for generating tensile stress to storage panels other than through framework expansion, namely engagement contraction methods. FIG. 29 is a top plan view of a unit's shelf featuring roller reefing devices. FIG. 30 is an enlarged sectional view of a draw latch engagement device. FIG. 31 is an enlarged fragmental perspective of a panel corner featuring a progressive engagement device.

Figure 32:
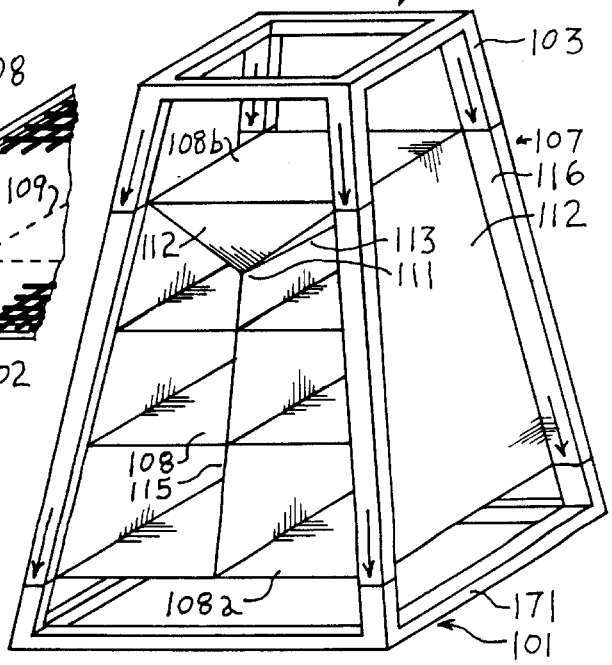

FIG. 32 is a perspective view of a dimensionally fixed, frustrum-shaped unit that illustrates the ninth embodiment of this invention, namely gravity-induced panel stressing. Note that the tenth and eleventh embodiments, namely panel shrinking and panel prestressing methods, respectively, are not illustrated but will be discussed later.

Figure 33:
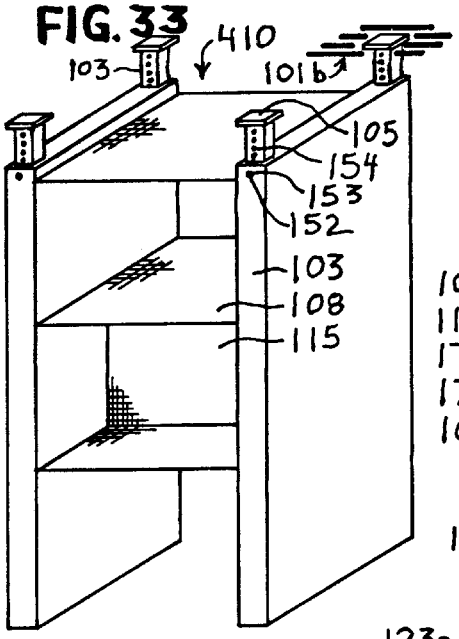
Figure 34:
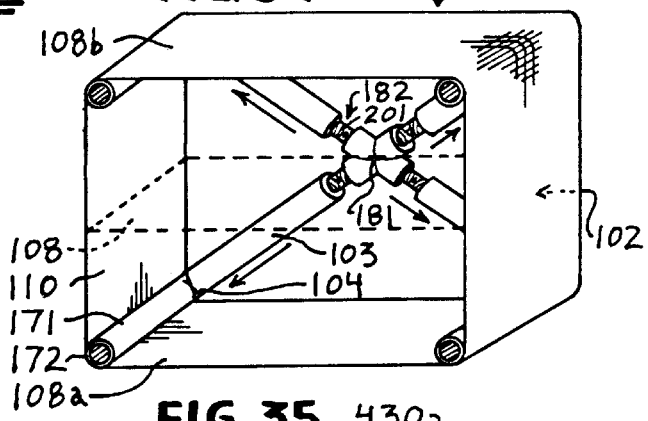
Figure 35:
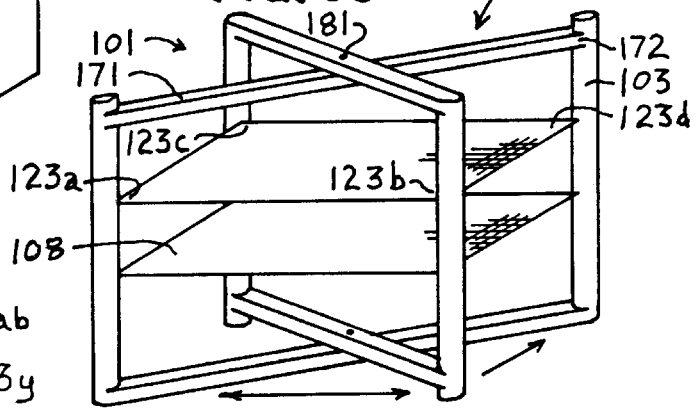
Figure 36A:
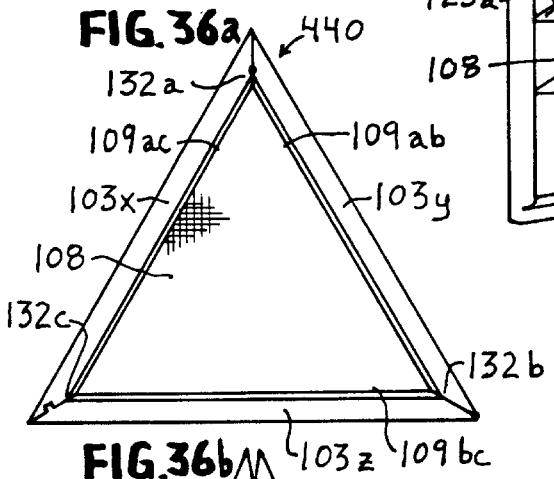
Figure 37:
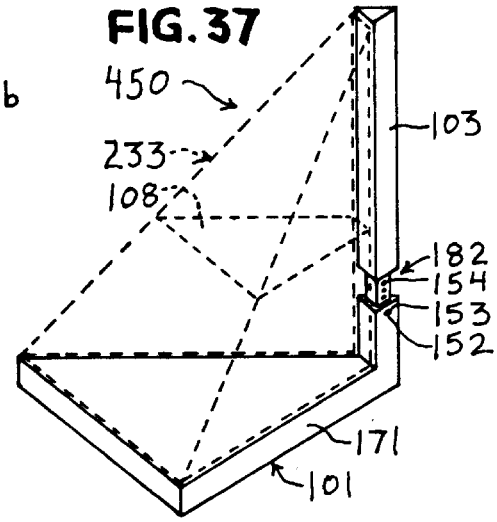

FIGS. 33 to 37 illustrate the twelfth embodiment, namely the combination of two or more tensile stress generating methods. FIG. 33 is an isometric perspective of a solid side direct placement unit. FIG. 34 is an isometric perspective of a cantilevered, elongated-side unit. FIG. 35 is an isometric perspective of a pivoting x-frame. FIGS. 36*a,* 36*b* and 36*c* show a series of top plan views of a solid side-hinge unit in progressive stages of folding. FIG. 37 is an isometric perspective of a fixed base unit with telescoping standard.

Figure 38:
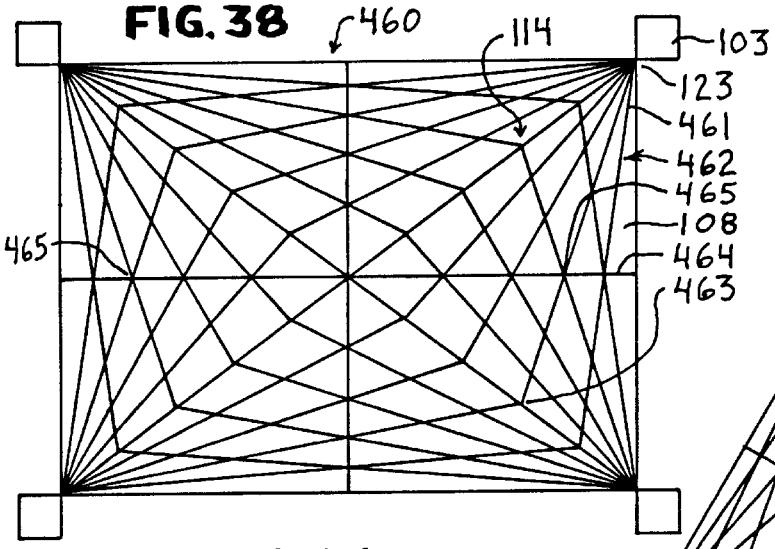
Figure 39:
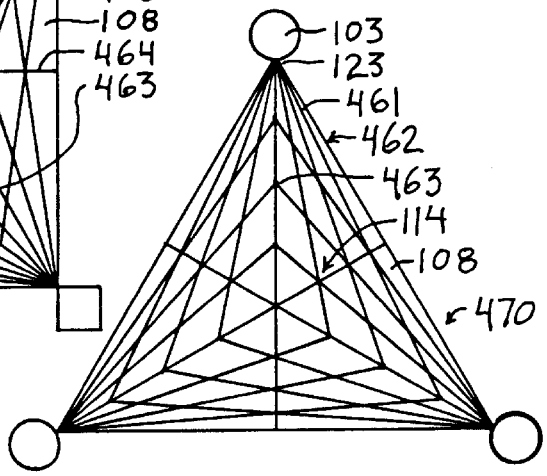
Figure 40:
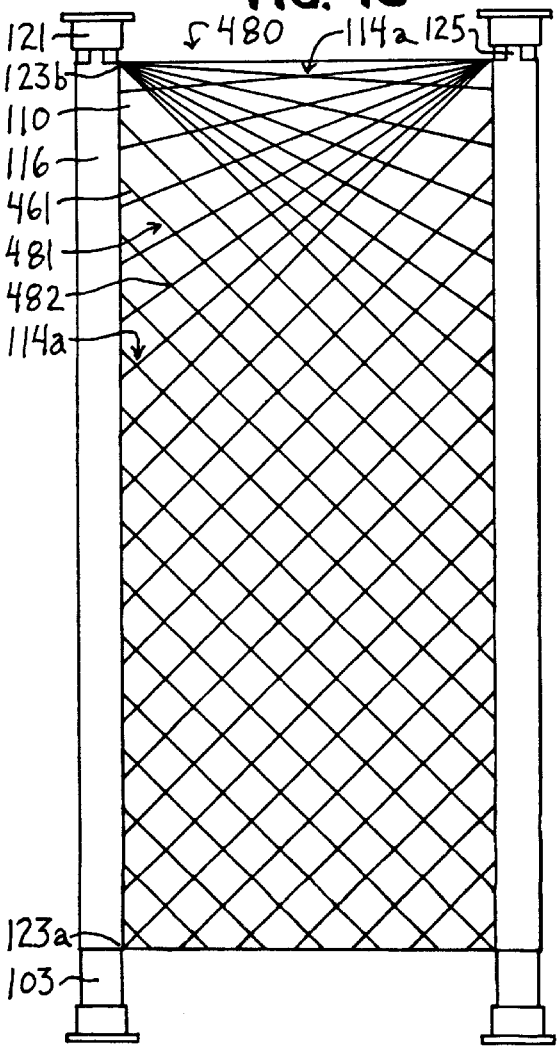

FIGS. 38 to 45 illustrate further embodiments of this invention that feature numerous load redistribution methods for improving the load-bearing capacity and rigidity of storage panels. Specifically, FIGS. 38 to 40 illustrate the thirteenth embodiment, namely intrapanel flexible reinforcement methods. FIG. 38 is a top plan view of a fixed-suspension rectangular shelf. Similarly, FIG. 39 is a top plan view of a fixed-suspension triangular shelf. FIG. 40 is a side elevation of a vertical panel featuring linear v-suspension.

Figure 41:
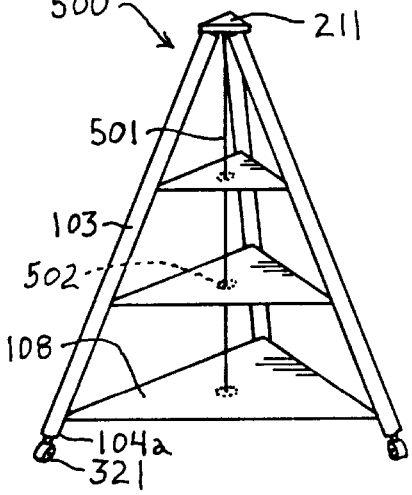

FIGS. 41 to 45, 48 and 49 illustrate the fourteenth embodiment, namely extrapanel flexible reinforcement methods. FIG. 41 is an isometric perspective showing a pyramid unit featuring a plumb suspension cable. FIG. 42 is a fragmental isometric perspective illustrating a unit with planar v-suspension. Similarly, FIG. 43 is a partial elevation view of wide-span v-suspension. FIG. 44 is a front elevation view of a unit featuring planar fixed-suspension. FIG. 45 is a fragmental perspective of a horizontal panel with vertical suspension braces. FIG. 48 shows a perspective view of another storage system featuring a panel bridge to achieve planar fixed suspension. FIG. 49 reflects a related storage system but engaged exclusively to horizontal support members with vertical struts.

LIST OF REFERENCE NUMERALS IN DRAWINGS

100 Floor/Ceiling Storage Chest
101 largely horizontal face
102 upwardly disposed face
103 upw. disp. support member
104 ends of upward members
105 rubber tip
106 apparent base
107 storage system
108 generally horiz. panel
109 hemmed border
110 vertical side panels
111 planar Y-network
112 sloped panels
113 stabilized susp. line
114 convergence angle
115 interior vertical panel
116 sleeve
117 seam
118 secondary vertical panel
120 Floor/Ceiling Triang. Unit
121 mounting flange
122 screw
123 panel corner
124 loops
125 hanging strap
130 Structural Template Unit
131 locator socket
132 horizontal face corner
133 progressive engage. device
140 Channel-Guided Unit
141 channel
142 keyhole entry
143 snap detent
150 Track-Guided Unit
151 raised track
152 lock pin
153 alignment hole
154 progressive set holes
160 Edge-Guided Unit
161 niche
170 Corner-Guided Unit
171 largely horiz. suppt. memb.
172 horizontal member end
173 portal
174 slideable junctures
180 Elongating Diagonal Unit
181 diagonal intersection pt.
182 adjustable bridging mech.
190 Elongating Perimeter Unit
200 Elongating Circular Unit
201 left/rt. hand thread rod
210 Elong. Pyramid Side Unit
211 apex
212 stepped overlap section
213 lateral edge
214 piano hinge
220 Elong. Sloped Diag. Unit
221 interior centerpoint
222 apparent lateral edge
223 panel windows
230 Elong. 3-way Elbow Unit
231 3-way corner
232 horizontal exterior end
233 storage grid
234 sloped stay

235 vertical stay
236 rivets
237 structural edge
238 imaginary edge
240 Concave Bow Spring Unit
241 bow springs
250 3-Way Spring Elbow Unit
251 vertex
260 Bi-Folding Diagonal Unit
261 folding joint
262 wing nut
270 Spoke Radial Unit
271 spoke members
272 inner planar component
273 apparent face corners
280 Folding Horizontals Unit
290 In-Fold Vertical Unit
291 lock collar
300 Retractable Corners Unit
301 joint lines
302 planar sections
303 sliding bolt
310 Bi-Fold Vertical Unit
311 engaged inside corners
312 alternating corners
313 diagonal cross braces
320 Spreading Pyramid Unit
321 castor wheels
330 Spread. Flared Leg Unit
331 sloped bottom portion
340 Out-Fold Verticals Unit
341 one-way ratchet device
345 Wedge Base Unit
346 wedge base
347 sloped lateral edges
350 Vert. Cylindrical Unit
351 cylindrical leaf spring
352 sliding clips
353 circular track
360 Telescoping Pyramid Unit
361 telescoping section
370 Outswing Corner Unit
371 ¼-circle cutouts
372 radius centerpoint
373 ⅛-circle pie sections
380 Roller Reefing Frame
381 roller reefing device
382 45° beveled gears
383 keyhole sockets
384 extension shaft
385 ratchet wheel
386 pawl
387 longitudinal slots
388 crank handle
390 Draw Latch Engagement
391 tension draw latch
392 pivot base bracket
393 draw hook
394 latch hook
395 lever
396 adjustable threaded sect.
400 Reinforced Panel Corner
401 belting
402 laminate coating
403 corner tab
404 comp. interlocking parts
405 Grav.-Stress Frustum Unit
410 Side Placement Unit
420 Elong. Cantilevered Unit
430 Pivoting X-Frame Unit
440 Hinged Wall Unit
450 Telescoping Stand. Unit
460 Fixed-Network Rect. Shelf
461 elongated fibers
462 linear fixed-susp. netw.
463 fixed fiber intersect pt.
464 fiber bridge
465 dual-tethered points
470 Fixed-Netw. Triag. Shelf
480 Stab.-Netw. Vert. Panel
481 linear stab.-susp. netw.
500 Center-Supported Pyramid
501 plumb suspension cable
502 button joints
510 Planar V-Suspended Syst.
520 Wide Span System
530 Sloped Storage Unit
531 fixed-suspension line
540 Suspension-Braced System
541 suspension brace panel
550 Hybrid Storage System
551 mini storage hammock
552 fabric pocket
553 horizontal batten
554 batten sleeve
555 vertical insert board
556 board sleeve
557 poll U-bracket
558 closet poll
560 Insertion Spreader Frame
561 horizontal channel
562 rigid strut member
563 fishmouth end
570 Sloped Storage System
571 panel bridge
580 Vertical Strut Frame

DESCRIPTION OF THE INVENTION

Embodiment 1:

FIG. 1 shows Floor-to-Ceiling Storage Chest 100, an example of the first embodiment of this invention. The rigid framework of unit 100 has two largely horizontal faces 101, a lower face or base 101*a* and an upper face 101*b,* in this case a floor and ceiling respectively, or two other suitably fixed, rigid opposing horizontal surfaces. Chest 100 has four upwardly disposed faces 102, each defined by pairs of adjacently positioned, upwardly disposed support members 103, which in this example are height-adjustable compression polls that are vertically oriented between and interconnect base 101*a* and upper face 101*b.* The support member ends 104, both lower ends 104*a* and upper ends 104*b,* are fitted with rubber tips 105 or other suitable non-slip, weight-distributing devices. Note that the collective points of contact between support member lower ends 104*a* and base 101*a* define the "apparent base" 106 of this framework. Furthermore, support members 103 represent the "lateral edges" of this framework.

Suspended from this framework is a storage system 107 made of flexible, tensilely strong and substantially inelastic material, in this case a canvas fabric. System 107 comprises a plurality of generally horizontal panels or shelves 108 and optionally non-horizontal panels as well. In this particular example, system 107 comprises two vertical side panels 110 horizontally connected by a plurality of shelves 108, including a bottom shelf 108*a* and top shelf 108*b,* whose ends are attached to side panels 110 via seams 117, in this case sewn. The suspension stability and load-bearing capacity of interior portions of system 107 are enhanced by planar Y-network 111 comprising two primary sloped panels 112*a* whose lower ends converge and attach at stabilized line 113*a,* thus forming convergence angles 114, the upper angle 114*a* being less than 180°, and whose upper ends are attached to side panels 110. Interior vertical panel 115 is suspended from stabilized line 113*a,* intersecting and attaching to all underlying shelves 108. In this particular case, Y-network 111 is enhanced with optional secondary stailized lines 113*b.* Specifically, primary sloped panels 112*a* are supplemented by secondary sloped panels 112*b* which emanate from the same framework-engagement point but which converge and attach to points along opposite primary panel 112*a* between primary stabilized line 113*a* and the framework, thus forming a corresponding set of secondary stabilized lines 113*b.* Secondary vertical panels 118 are attached and suspended from secondary lines 113*b,* intersecting and attaching to underlying panels 108, thus providing further compartmentalized storage options. Accordingly, dynamic loads on panels 118 and 115 are effectively redistributed via v-suspension to the framework. All panels throughout system 107 are suitably reinforced at their borders, in this case with hemmed border 109. Finally, vertical sleeves 116, which are closed at the upper end and are attached to side panels 110 along the front and back hemmed borders 109, serve as a method of engaging system 107 to support members 103.

Regarding operation, after being inserted into sleeves 116 and fitted with rubber tips 105, support members 103 are drawn apart from the unit's imaginary vertical axis, using an applied force, until the slack and initial elasticity of shelves 108 have been removed and support members 103 have been directly placed to interconnect base 101*a* and upper face 101*b.* Note that the outward placement of members 103 is determined only by the resistance of system 107 and no structural connection. Clearly, the direct placement of members is infinitely adjustable depending on the desired level of panel tension and anticipated loads. The compression fit provided by screw or spring tension effectively locks support member 103 in this desired lateral position. This direct placement procedure tensilely stresses shelves 108 in two largely perpendicular horizontal directions, namely diagonally, and non-horizontal panels in at least one direction, namely fore-aft. Additionally, since system 107 is suspended from support member upper ends 104*b,* the gravitational pull of static and dynamic loads on shelves 108 causes sleeve engagement 116 to stretch and extend downwards on support member 103, thus tensilely stressing vertical panels 110, 115 and 118 as well as sloped panels 112 in a second largely perpendicular direction. The downward slippage of sleeve 116 along member 103 may be manually assisted if excessive friction prevents automatic slippage, so as to insure proportionate stressing of all non-horizontal panels.

Fabric selection for storage systems is dependent on the intended storage use, anticipated static and dynamic loads, environment, etc. Any fabric, woven or non-woven, natural or synthetic, that is flexible, tensilely strong and substantially inelastic relative to the anticipated static and dynamic loads is acceptable including cotton canvas, sport nylon, polyester, polypropylene, fiberglass, Kevlar®Aramid, carbon fibers or other suitable fabric types or laminated combinations known to the trade. Note that theoretically, if storage system fabric had 0% elasticity, then the tensioning process would not need to be adjustable. However, since most materials have at least some degree of elasticity, the adjustability feature is desirable. Furthermore, note that use of more than one fabric type in opposite parallel panels requires either a) similar rates of elasticity or b) proportionate dimensional compensation. Additional fabric performance characteristics to consider include flame retardancy, tear resistance, puncture resistance, abrasion resistance, chemical resistance, weather resistance, stain resistance, washability, breathability and other usage-relevant properties. Indeed, a broader interpretation of "fabric" for potential use as panels in system 107 should include somewhat stiffer, yet still flexible thin sheet material like metal, plastic or plywood that would not normally be considered suitable in this thinner format for storage shelving, without tensile prestressing.

Regarding the attachment of panels, there are numerous alternatives to sewn seam 117, including glued, riveted or even heat seamed depending on the nature of panel material. However, a less permanent method of panel attachment would have several advantages including panel removability and interchangability as well as grater flexibility in layout modifications. Temporary attachments utilizing snap fastener, interlacing, zipper, hook 'n eye, Velcro®-type or Ziplok®-type interface methods are all viable, providing the attachment 1) is reliably secure under anticipated static and dynamic loads and 2) effectively transfers loads between adjacent panels. Note that panels of system 107 should be reinforced where necessary at several key load-bearing points, especially exposed panel borders, intersections of shelves 108 with interior vertical 115, convergence of sloped panels 112 at stabilized line 113, points of engagement with framework or any other specific weight transference points. Numerous reinforcement options exist besides hemmed border 109, including heavier fibers and fabric, cross-stitching, belting, sandwiched laminations, etc. as would be known to those in the trade.

As mentioned earlier, system 107 is engaged to the framework via sleeves 116, which allow gravity-induced vertical stressing of the system's optional non-horizontal panels. Sleeve 116 can be considered a "traveling" engagement regarding vertical movement of panels in a direction parallel to members 103, as well as a "fixed" engagement regarding perpendicular movement of panels from members 103. Numerous other acceptable traveling engagement devices are known to the trade, including for example those used in sailboats whereby the mainsail has a traveling engagement with both mast and boom via track/clips, keyhole channels, or loops etc. to allow desirable fabric tensioning while maintaining engagement. For discussion purposes, "adjustable" engagement refers to engagements that allow a range of measured movement of panels to and from or along framework support members.

Note that in chest 100, storage system 107 is engaged to the framework such that the uppermost plane of engagement is vertically and horizontally fixed, in this case via the closed end feature of sleeve 116, while all engagement below this uppermost plane are traveling. Furthermore, note that if side panels 110 were fixedly engaged by both their upper and lower end corners to members 103, instead of fixedly and travelingly engaged, then vertical stressing would have to be accomplished by some method other than gravity-induced. For example, a similar application of the direct placement method could also be used in a vertical direction to stress non-horizontal panels. Theoretically, if the upper and lower ends of vertical side panels 110 had a traveling engagement to hypothetical horizontal polls, then direct placement of these polls in opposite directions away from the framework's centerpoint and interconnection to opposing fixed vertical surfaces would achieve the desired effect. Alternatively, if the upper and lower end corners of system 107 were fixedly engaged to compression polls 103, then elongation of these polls for floor-to-ceiling height adjustment would effectively stress non-horizontal panels.

Regarding framework construction, material selection is determined by overall size, anticipated storage loads, and engineered design. Structural members can be made from a wide range of trade-knowledgeable materials including wood, metal alloys, composites, rigid plastic or fiberglass so long as the framework would remain substantially rigid while system 107 is tensilely stressed. Support members 103 need not be elongated in shape as will be seen in other embodiments. Interconnections between support members 103 and horizontal faces 101 are ideally easily removable to enhance knockdownability, providing that interconnections are effectively locked and stationary under anticipated stressed conditions. Note that hypothetical use of rigid spreaders or braces between support members 103 is acceptable providing that 1) lateral movement of members 103 outwards from the vertical axis is unrestricted and 2) storage space of chest 100 is largely uncompromised. Also, since all floor-to-ceiling units are designed to capitalize on the inherent strength of the site structure, any structural limitations of the existing floor and ceiling should be reflected in the design, placement, loading and weight distributing capability of support members 103, which will be trade understood.

As will be evident from ensuing embodiments, storage furniture according to the present invention can assume all manner of configurations beyond the traditional, right rectangular prism-shaped chest 100 as shown in FIG. 1. Storage furniture can have three or more upwardly disposed faces 102, sloped or vertical, and one or more horizontal faces 101. The supporting framework can assume an infinite number of configurations, providing that rigidity is maintained while the storage system is tensilely stressed. Similarly, storage systems can assume an equal number of diverse configurations, providing the exterior perimeter is compatibly shaped with the framework. Non-horizontal panels are optional except for a small class of frameworks to be discussed in later embodiments.

Regarding storage system design in FIG. 1 and other comparable units, note that in addition to vertical side panels 110, system 107 could be fitted with a stressed back panel and unstressed draped front curtain panels for obvious dust protection, privacy or appearance reasons. If system 107 is limited to horizontal panels 108 only, then these panels must be fixedly engaged directly to the structural framework by at least their corners. Planar Y-network 111 need not be symmetrical, can assume any slope or slopes, and can be oriented in any direction. Storage should not necessarily be limited to shelves 108, but rather may include sloped panels 112 as well as vertical panels 110 and 115 via pockets, hooks, towel-rings or other trade-knowledgeable vertically mounted storage devices. Clearly, the more panels that are incorporated into system 107, the greater the storage compartmentalization and organizational benefits, plus the greater the inherent strength of system 107 while suspended and stressed, without the disadvantage of excessive weight and cost. Finally, note that the hypothetical use of unstressed, hammock-style storage panels is acceptable, providing they operate independently from stressed panels and do not compromise the tensioning process. For example, the unstressed mini storage hammocks 551 and fabric pocket 552 as illustrated in FIG. 46 operate independently of the system's stressed horizontal panels 108, vertical side panels 110 and interior vertical panels 115.

FIG. 2 shows Triangular-Shaped Unit 120, which is designed to fit into room corners. Similar to FIG. 1, support members 103 are height-adjustable for floor to ceiling fit and are directly placed to outward positions that tensilely stress the storage system. However, members 103 are locked into position with base 101*a* and upper face 101*b* via mounting flanges 121 and screws 122 instead of compression fit. The storage system is somewhat different from that shown in FIG. 1 since chest 120's Y-network 111 incorporates a fixed suspension line 531, as opposed to chest 100's stabilized line 113, given the additional presence of shelf 108 that intersects line 531. This will be discussed further in FIG. 44. Additionally, since chest 120 has no vertical side panels 110, shelves 108 and sloped panels 112 must be engaged directly by their corners 123 to members 103. Again, note that wherever gravity-induced vertical stressing is desired, the uppermost plane of engagement must be fixed, in this case via hanging straps 125, while all underlying panels that are interattached via non-horizontal panels must be travelingly engaged, in this case via loops 124. Regarding operation, as shelf 108 tensioning increases, the friction of loops 124 against members 103 prevent any undue slippage under storage loads. Accordingly, applied downward force is required on loops 124 to insure proportionate downward travel along members 103, relative to non-horizontal panel tensioning.

FIG. 3 shows Structural Template Unit 130, another example of the first embodiment that incorporates a direct placement method of expanding the framework. Unlike the previous two examples that required the structural presence of a floor and ceiling, unit 130 is free-standing. Support members 103 interconnect with two opposing horizontal faces 101 which are rigid, planar-like and have locator sockets 131 at or near the face corners 132. Sockets 131 are compatibly-shaped to receive member ends 104. For visual simplicity, storage system 107 consists only of horizontal panel 108, which is effectively stressed as members 103 are drawn outwards under applied force and placed directly into corresponding sockets 131, which serve to lock in the desired lateral position. Simultaneously, the horizontal tension of member ends 104 against the inside wall of socket 131 provides sufficient friction to maintain vertical interconnection with horizontal faces 101. Note that since faces 101 have only one set of sockets 131, panel corners 123 are adjustably engaged via progressive engagement device 133 to provide adjustability to panel stress. See FIG. 31 for details. An alternative would be to incorporate a series of sockets on faces 101 either in overlapping linear alignment or staggered positions from the centerpoint toward each corner 123 to provide a sufficient range of adjustability from significant to subtle changes depending on the fabric type, desired tension, anticipated loads, etc. Also note that, in its present configuration, unit 130 is subject to parallelism tendency, which can be easily rectified either by a) any trade-knowledgeable rigid, diagonal bracing or preferably b) incorporating optional non-horizontal panels similar to those used in FIG. 1. Specifically, hypothetical use of vertical side panels 110, Y-network 111 and other sloped panel alternative layouts to be discussed later would serve to inhibit fore-aft and side-to-side parallelism. Finally, note that as with any free-standing storage furniture unit, numerous trade-knowledgeable steps can be taken if necessary to enhance the unit's fore-aft and side-to-side stability including: avoidance of excessive top loading, base securement to floor, backside securement to wall (e.g. wall ties), base extensions, etc.

FIGS. 46 and 47 are additional examples of direct placement framework expansion, in this case reflecting an alternative method of locking the expanded position. Specifically, FIG. 47*a* and *b* shows Insertion Spreader Frame 560 in contracted and expanded modes, respectively. In this particular example, storage system 107 is prestressed in a fore-aft direction and engaged to planar-like side support members 103. Once members 103 have been direct placed outwards sufficiently to tension system 107, this expanded position is locked by inserting rigid strut members 562 through optional horizontal channels 561 or similarly effective channeling method. Although the tension of system 107 will tend to hold strut members 562 in position, their position can be fixed permanently via glue, nails etc. or temporarily via screws or other trade-knowledgeable method. FIG. 46 shows a different form of strut member 562, in this case elongated in shape with fishmouth ends 563 and inserted diagonally between opposite support members 103.

In general, strut members 562 can take numerous other shapes, as will be trade-understood. Strut members 562 should be designed for insertion so that vertical support members 103 need not be placed outwards beyond the point of desired expansion. Indeed, the insertion ends of strut members 562 can be tapered somewhat to ease insertion and assist framework expansion. Additionally, the ends of strut members 562 can be articulated or hinged in design to assist insertion and fixing in place. Finally, strut members 562 can be adjustable in length for ultimate insertion ease and tension fine-tuning capability of system 107.

In sum, FIGS. 1 to 3, 46 and 47 are all examples of the direct placement method of framework expansion, whereby support members 103 are unrestricted in lateral movement except by the presence of horizontal panels 108 or sloped panels 112. Note that all five units could function equally as well in a horizontal orientation with members 103 extending between two vertical faces, such that direct placement would provide vertical and fore-aft panel stressing to create vertical storage compartments. Also note that although FIGS. 1 to 3 only illustrate horizontal direct placement, vertical direct placement is equally feasible to achieve vertical framework expansion, if desired. FIG. 49 illustrates an example of exclusive vertical direct placement requiring vertical rigid strut members 562.

Embodiment 2:

FIGS. 4 to 7 serve to illustrate the second embodiment of this invention, namely the directional guiding method of framework expansion. FIG. 4 shows the lower portion of Channel-Guided Unit 140. Again for visual simplicity, system 107 comprises only horizontal panel 108. This free-standing unit has two horizontal faces 101 that are rigid and planar-like with channels 141 directionally oriented from the face center point towards face corners 132. Channels 141 slideably interconnect with support members 103 whose ends 104 are compatibly shaped. Additionally, channels 141 have keyhole entry 142 at their inboard end as well as releasable, one-way snap detents 143, in this case spring-loaded, along their length so that as members 103 are drawn, with applied force, outwards from the vertical axis, member ends 104 are guided unslippingly towards face corners 132. As panels 108 become effectively stressed, members 103 are automatically locked into the desired lateral position by snap detents 143.

FIG. 5 shows an enlarged base corner of Track-Guided Unit 150, another example of a directional guiding method of framework expansion. Raised tracks 151 are mounted on horizontal faces 101 between the face center point and corners 132. Member ends 104 are compatibly shaped to slideably interconnect to track 151. Panel stressing operation is similar to that used in unit 140. In this case, the desired lateral position is maintained by lock pin 152 through both alignment hole 153 on member ends 104 and progressive set holes 154 on track 151.

The top plan view of Edge-Guided Unit 160 in FIG. 6 illustrates how structural edges can guide the expansion of frameworks. Specifically, the edges of horizontal face 101 are ripple-shaped with progressive niches 161 from side midpoint to corner 132, said niches being compatibly shaped to lockingly embrace members 103 as they are incrementally drawn, using applied force, from 103*a* to 103*b* and finally to 103*c* at their respective face corners. Fabric tension acts to hold the engaged support members 103 firmly against the guiding edges. As members 103 are shifted towards corners 132, the diagonal distance between "apparent" base corners increases, thus enlarging the frame horizontally and stressing the hypothetically engaged storage system.

FIG. 7 shows the lower portion of Corner-Guided Unit 170 in a contracted position, yet another example of guided framework expansion. Unlike the previous examples, horizontal faces 101 in this case are not solid, but rather consist of four horizontal members 171 that are elongated and slideably interconnected at right angles. Each member 171 has a first end 172*a* with a portal 173 that is horizontally oriented and compatibly shaped to receive and be intersected by the second end 172*b* of adjacent member 171. Upward members ends 104 are fixedly interconnected at slideable junctures 174 between corresponding horizontal faces 101. This framework configuration is designed to guide the expansion of both horizontal faces 101, thus moving the interconnected upward members 103 outwards from the vertical axis to effectively stress the hypothetically engaged shelf 108. Lock pins 152 through portal alignment holes 153 and progressive set holes 154 in horizontal members 171 would maintain this panel stress.

In sum, FIGS. 4 to 7 are four examples of free-standing units that demonstrate the second embodiment, namely the directional guiding method of framework expansion, in these cases horizontal. Clearly, there are numerous other trade-knowledgeable guiding configurations that would achieve similar net results. Note that the same directional guiding principle can be used to achieve upward face expansion. For example on sailboats, the vertical support member, i.e. mast, can be in effect expanded by guiding the horizontal member, i.e. boom, downwards toward the mast's base via sliding track and downhaul arrangement, thereby expanding the vertical face. Also, FIGS. 4 to 7 could all be modified to allow upward members 103 to slideably intersect one or both horizontal faces, which could then be guided apart for vertical expansion. Alternatively, vertical stressing could be accomplished by gravity-induced stressing as shown in FIG. 1 or by elongation of upward members 103, to be discussed next.

Embodiment 3:

FIGS. 8 to 13 are examples that illustrate the third embodiment of this invention, namely framework expansion through elongation of support members or faces. FIG. 8 shows the lower portion of Elongating Diagonal Unit 180, which has two horizontal faces 101 each comprising two horizontal members 171 which are diagonally oriented and interconnect at diagonal intersection point 181. Members 171 are discontinuous between point 181 and member ends 172, with an adjustable bridging mechanism 182 in-between, in this case a telescoping inner tube with lock pin 152, alignment hole 153 and progressive set holes 154. Upward members 103 perpendicularly interconnect with horizontal member ends 172. Interconnections at ends 172 and point 181 can be a permanent type such as welded or preferably a more temporary type as with a slip coupling device to enhance knockdownability. Regarding operation, as applied force is used to elongate bridge 182, upward members 103 shift outward from the vertical axis to effectively stress hypothetical shelf 108. Lock pin 152 would maintain framework position and panel stress.

FIG. 9 shows the lower portion of Elongating Perimeter Unit 190, another example of expanding framework with elongating horizontal members 171 located not within but rather between horizontal faces 101. Specifically, each upward face 102 comprises two upward members 103, in this case vertical, spaced by two horizontal members 171, each being discontinuous with an adjustable bridging mechanism 182 in between, namely telescoping sections incorporating lock pin 152, alignment hole 153 and set holes 154. Operation is similar to unit 180 in FIG. 8.

FIG. 10 shows the lower portion of Elongating Circular Unit 200, an example of expanding framework that features a simpler way to simultaneously move upward members 103 outwards from the vertical axis. Specifically, horizontal faces 101 each comprise one horizontal member 171 that is elongated, generally circular and discontinuous with an adjustable bridging mechanism 182 in between ends 172. Although telescoping sections as used in the two previous examples would suffice here, the bridging mechanism in this case is a short, straight length of a combination left and right hand-threaded rod 201 with member ends 172 correspondingly threaded. Upward members 103 are interconnected to faces 101 around their perimeter with interconnection points defining the "apparent" base, in this case triangularly-shaped. Regarding operation, as force is applied to revolve bi-threaded rod 201, the distance between ends 172 is alterable, in effect changing the circumference of horizontal faces 101, thereby simultaneously shifting all upward members 103 either inwards or outwards from the vertical axis. Friction of threaded rod 201 serves to lock this desired lateral position.

FIGS. 11*a* and 11*b* show two views of Elongating Pyramid Side Unit 210, illustrating expansion and contraction of both elongated and planar-type support members. Unit 210 has four upwardly disposed faces 102*a, b, c* and *d* that are sloped and converge at apex 211. Faces 102*a, b* and *c* are both planar-like and discontinuous between their bottom and apex 211, having an adjustable bridging mechanism 182 in between, in this case comprising complimentary-shaped stepped overlap sections 212, interconnected via lock pin 152, alignment hole 153 and set holes 154 or other suitable interconnection method. Faces 102*a, b* and *c* are interconnected along their common lateral edges 213, in this case via piano hinge 214. Face 102*d* comprises one horizontal member 171 that is telescoping and whose ends 172 are hingedly interconnected to lateral edges 213 of adjacent faces 102*a* and *c* such that ends 172 at least can rotate up and down to maintain the horizontality of member 171 as it expands or contracts. Unit 210 is depicted with horizontal panels 108, which are engaged to the inside of lateral edges of face 102*a, b* and *c*. Regarding operation, as applied force reduces the overlap of stepped sections 212, all faces 102 expand, thereby shifting lateral edges 213 outwards from the vertical axis and effectively stressing panels 108. Note that hypothetical use of optional vertical panels in unit 210 is possible either by appropriate dimensional sizing or with the use of adjustable engagement devices that can counteract the reduction in height as pyramid base 101 and faces 102 expand.

FIG. 12 shows Elongating Sloped Diagonal Unit 220, an example of a framework that provides 3-way expansion. Unit 220 is right rectangular prism-shaped and has four upward members 103 that are elongated and oriented in a sloped diagonal direction between lower face 101*a* and upper face 101*b*, intersecting at interior centerpoint 221. Members 103 furthermore being discontinuous between centerpoint 221 and ends 104 with an adjustable bridge mechanism 182 in between, in this case bi-threaded rods 201 with complimentary threading in the discontinuous ends. The "apparent" base of unit 220 is defined by the upward member ends 104 where they contact the floor, while the "apparent" lateral edges 222 are imaginary lines between vertically aligned corners of faces 101*a* and *b*. The storage system has an exterior envelope comprising two vertical side panels 110 attached at their ends to two horizontal panels 108*a* and *b*, bottom shelf and top shelf, respectively. Furthermore, hypothetical sloped panels 112 are suspended between lower face 101*a* and upper face 101*b* with additional hypothetical shelves 108 and secondary vertical panels 118 suspended between sloped panels 112. The system envelopes and is effectively engaged to upward member ends 104 via corner enclosure panels 224. Additionally, the system has appropriate panel windows 223 for through-passing support members. Regarding operation, as applied force revolves bi-threaded rods 201, upward members 103 lengthen by moving outwards from centerpoint 221, thereby increasing width, depth and height dimensions of the framework and engaged system. Note that although the framework by itself may be somewhat unstable at interior centerpoint 221, the framework in combination with the engaged and tensilely stressed storage system becomes remarkably rigid. Additionally, note that any face of unit 220 can effectively serve as a base.

FIG. 13 shows Elongating 3-Way Elbow Unit 230 which represents a small, but distinct class of frameworks wherein the horizontal cross-section of upward support members above base level has less than three non-linear points. This particular class of framework requires not only use of a three-dimensional storage system, comprising both horizontal and non-horizontal panels, but also tensile stressing in a least three largely perpendicular directions. Specifically, unit 230's framework comprises two horizontal members 171 that are elongated and perpendicularly interconnected, forming horizontal face 101, plus one upward member 103 that is similarly elongated and perpendicularly interconnects with members 171 to form a 3-way right angle framework with 3 upward faces 102. Adjacent faces form a plurality of structural edges 237 and a plurality of imaginary edges 238. Upward member 103 is discontinuous between 3-way corner 231 and upper end 104*b*. Similarly, horizontal members 171 are discontinuous between corner 231 and their exterior ends 232. Adjustable bridging mechanisms 182 are positioned between all three discontinuous lengths, in this case telescoping sections with corresponding lock pin 152, hole 153 and set holes 154 or other suitable device.

Unit 230's three-dimensional storage system or grid 233 comprises two sloped, elongated panels or stays 234 that suspend between member upper end 104*b* and exterior ends 232 and one vertical, elongated panel or stay 235 that suspends between upper end 104*b* and corner 231. Stays 234 and 235 are engaged at their ends to the framework with rivets 236 or other suitable engagement device. A plurality of horizontal panels 108, triangular in shape, are suspended between and sewingly attached to stays 234 and 235 or by other trade-knowledgeable attachment method. Regarding operation, applied force elongates telescoping sections until storage grid 233 is effectively 3-way stressed in width, depth and height, while lock pins 152 maintain the framework's elongation and panel stress. Note that any compatibly shaped configuration of storage grid 233 is acceptable for this particular framework class including hypothetical use of triangularly shaped vertical side panels 110 in addition to or instead of stays 234 and 235, providing the resulting configuration is three dimensional and fully integrated for 3-way stressing. Furthermore, this class of framework requires a storage grid that includes a plurality of non-horizontal panels that at least have a border that extends along imaginary edges 238 that are sloped.

In sum, FIGS. 8 to 13 are all examples of the third embodiment that achieve framework expansion via elongation, resulting from a variety of adjustable bridge mechanisms 182 including telescoping members, stepped overlap sections, and bi-threaded expansion rods. Clearly, numerous other trade-knowledgeable elongation methods would be acceptable within the context of this invention. Rigid insertion extenders, hydraulically or pneumatically driven expansion chambers, etc. are all viable elongation alternatives. Furthermore, these illustrations demonstrate that whatever elongation method is utilized can be incorporated into the horizontal faces 101, upward faces 102, interior regions or combinations thereof to achieve the required 2 or 3-way framework expansion and panel stressing.

Embodiment 4:

FIG. 14 of Concave Bow Spring Unit 240, shown without a storage system, illustrates the fourth embodiment that achieves framework expansion via spring tension. Specifically, unit 240 uses four bow springs 241 to serve as upward members 103 between the two horizontal faces 101. Bow springs 241 are vertically oriented, concave to the vertical axis and rigidly interconnected to faces 101. Regarding operation, after applied force moves springs 241 towards the vertical axis in order to engage hypothetical horizontal panels 108 at their corners 123, springs 241 are allowed to relax, thus generating continuous expansive pressure for effective panel stress. Note that when springs 241 are tensioned, the net effect on framework dimensions is an increase in height and a decrease in width and depth. Accordingly, dimensions of the storage system should anticipate this movement; i.e. shelves should be dimensionally less than and optional vertical panels at least equal to the fully relaxed corresponding framework dimensions, whereby unit 240 will effectively provide both horizontal and vertical stressing. Also, note that spring strength should exceed the anticipated combined static and dynamic stress loads.

FIG. 15 shows 3-way Spring Elbow Unit 250, another example of a spring expanded framework. It's framework profile is similar to FIG. 13, wherein the horizontal cross-section of upward support members has less than three non-linear points, and as such would require a hypothetical storage grid and 3-way tensile stressing. Unit 250 differs from unit 230 in that horizontal members 171 and upward member 103 are not elongating but rather bow springs 241 that merge at 3-way corner 231 and are convex to the imaginary 450 sloped axis that intersects vertex 251. Bow springs 241 are compressed toward this sloped axis to engage the storage grid and released to generate 3-way stressing.

In sum, FIGS. 14 and 15 are just two of the numerous ways springs can be used to generate framework expansion both horizontally and vertically. Clearly, all manner of spring mechanisms, including helical coil springs, cantilevered leaf springs, combinations etc. are viable alternatives for generating expansive tension. As will be understood by those in the trade, spring mechanisms can be incorporated into the framework's horizontal faces 101, upward faces 102 or interior regions to achieve the necessary multi-directional framework expansion and panel stressing.

Embodiment 5:

FIGS. 16 to 21 show six different units that illustrate various aspects of the fifth embodiment of this invention, namely frameworks that expand and contract via folding action. FIG. 16 shows the lower portion of Bi-Folding Diagonal Unit 260 in stick format in a partially contracted position with a simplified storage system for visual clarity of framework motion. Unit 260's folding action occurs in its two horizontal faces 101 which each comprise two horizontal members 171 that are diagonally oriented and rotatably interconnected at intersection point 181. Members 171 have a folding joint 261 between intersection point 181 and their exterior ends 232, which are vertically interconnected by upward members 103. For discussion purposes, the framework will be defined as in "first position" when members 171 are folded at joint 261 and in "second position" when members 171 are largely straight. Regarding operation, as applied force unfolds members 171 from first to second position, upward members 103 move outwards from the vertical axis, thus stressing shelf 108 in two largely perpendicular horizontal directions. Wingnut 262 (unshown) at joint 261 locks members 171 in this desired lateral position. Clearly, numerous alternative trade-knowledgeable locking devices could be employed here. Note that this framework can be folded virtually flat, without an engaged storage system, for shipping and handling ease.

FIG. 17 shows the lower portion of Spoke Radial Unit 270, another type of folding framework, here in partially contracted position without a storage system and in stick format for visual clarity. As in the previous example, unit 270's folding action occurs in its two horizontal faces 101 which each comprise five horizontal members including four elongated spoke members 271 that are rotatably interconnected with a rigid, inner planar component 272. Spoke members 271 are confined to rotation within the same plane as component 272 and radiate towards apparent face corners 273. Vertical upward members 103 interconnect member exterior ends 232. Regarding operation, applied forces rotate component 272 in a clockwise direction from a first contracted position to a second position when spoke members 271 and upward members 103 are fully extended from the framework's vertical axis. A hypothetical snap detent effectively locks spoke members 271 in this second position. Note that in this as well as the previous example, the alternative of having folding action employed in the vertical faces instead of horizontal faces would result in not only 2-way horizontal, but also vertical expansion.

FIG. 18 shows the lower portion of another folding framework in stick format in a partially contracted position, namely Folding Horizontals Unit 280, which features folding action within its upward faces 102 unlike the previous two examples. Specifically, faces 102 comprise two upward members 103 spaced by two elongated, parallel horizontal members 171 which have a folding joint 261 midway and whose ends 172 are hingedly interconnected to members 103. During operation, members 171 move from a first folded position to a second straight position which collectively move members 103 outwards from the vertical axis. Snap detent 143, or other suitable locking device, secures joint 261 in the 180° open brace position. Note that this particular folding configuration allows upward members 103 to collapse almost completely towards the vertical axis, with or without an engaged storage system, for shipping and handling ease.

FIG. 19 shows In-Fold Vertical Unit 290, in stick format in partial contraction without storage unit to demonstrate folding action that expands the framework vertically as well as horizontally. Four upward members 103 each having a folding joint 261 midway are hingedly interconnected to faces 101 such that folding action is directionally to and from the vertical axis. First position is defined as when members 103 are folded inwards and second position when members 103 are substantially straight. Regarding operation, after a hypothetical storage unit is engaged in first position, applied force is used to rotate members 103 outwards from the vertical axis to second position when lock collars 291 are slid downwards over joints 261 to maintain panel stress. The net effect of this reconfiguration is tensile stressing in three largely perpendicular directions. Note that folding joints 261 can alternatively be located at any common height between faces 101. Also, note that depending on the length of members 103, unit 290 can potentially be folded substantially flat, with or without the storage unit, for shipping and handling ease.

FIG. 20 is an enlarged view of a base corner of Retractable Corner Unit 300 in contracted position that illustrates the folding action of a framework with more planar-like, versus elongated, support members in contrast with previous examples. Specifically, unit 300's horizontal faces 101 are planar and discontinuous along joint lines 301 that parallel the diagonal of adjacent corners. Each corner 132 comprises four planar sections 302*a, b, c* and *d* that are hingedly interconnected such that adjacent sections can alternatingly fold in accordion-like fashion. Upward members 103, in this case elongated and vertical, interconnect faces 101 between corresponding corners 132 on section 302*d*. Regarding operation, applied force moves planar sections 302*b* and *c* from a folded or first position to the second position when sections 302*a, b, c* and *d* form an extended plane. Sliding bolt 303 is then engaged between section 302*a* and *b* to maintain the second position. The net result forces members 103 outwards from the vertical axis, thus expanding the framework horizontally in two, largely perpendicular directions.

FIG. 21's top plan view of Bi-Fold Vertical Unit 310 illustrates the expansive folding action of planar-like upward faces. Specifically, Unit 310's framework comprises eight upward support members 103 that are planar-like, rectangularly shaped, vertically oriented and hingedly interconnected to adjacent members. Horizontal panel 108 is engaged to inside corners 311 and not engaged to alternating corners 312. Although unshown, at least one of members 103 has openings suitable for access to shelves 108 from the outside. Regarding operation, applied force is used to make engaged corners 311 expand outwards from the vertical axis such that the angle at corner 311 decreases from greater than 90° or first position, when shelves 108 are engaged but slack, to the second position when corners 311 form right angles and the diagonal distance between opposite corners 311 is maximized and equal. The net result is effective diagonal stressing of shelves 108 in largely perpendicular directions. Once second position is achieved, hypothetical horizontal diagonal cross braces or other suitable locking device is used to maintain this second position. Note that in its current configuration, unit 310 can be folded virtually flat without shelves 108 for shipping and handling ease. Furthermore, upward members 103 need not be symmetrical and alternative tri-fold, quadrifold, etc. type-configurations are feasible, providing the distance between corners 311 can be contracted and expanded appropriately. Finally, note that in this particular case, as engaged corner 311 expands outwards, alternating corners 312 actually move inwards toward the vertical axis. Accordingly, engaged corner 311 is referred to as the "key section" of upward member 103 that moves outwards for horizontal expansion and stressing.

In sum, FIGS. 16 to 21 illustrate six contrasting examples of the fifth embodiment, namely articulated frameworks, that demonstrate various aspects of folding action to achieve both 2-way and 3-way framework expansion and contraction. Clearly, numerous other trade-knowledgeable folding configurations are viable in the context of this invention, providing that folding action either directly or indirectly at least moves the key sections of support members outwards from the vertical axis or interior centerpoint. Note that although all the above examples reflect frameworks with two horizontal faces, single-based or pyramidal-type articulated frameworks are equally viable so long as upward members 103 are hingedly interconnected with horizontal face 101 and apex 211. Additionally, note that in order to provide adjustability to panel stressing, all articulated frameworks should incorporate either a) some form of progressive locking device, like ratcheting or wingnut, at folding joints 261 or b) some form of progressive engagement device 133 between the storage system and framework, as shown in unit 130 of FIG. 3.

Embodiment 6:

FIGS. 22 and 23 illustrate the sixth embodiment of this invention, namely frameworks that achieve horizontal expansion via gravitational force. In addition to vertical stressing as discussed earlier, gravity can also induce automatic horizontal framework expansion and thus horizontal panel stressing for a particular class of frameworks, as follows.

FIG. 22 shows Spreading Pyramid Unit 320, which is tetrahedron-shaped and comprises three elongated and sloped upward members 103 hingedly converging at apex 211. Importantly, no fixed-dimensioned cross members interconnect members 103 below apex 211 that would prohibit expansion. Member bottom ends 104*a* are fitted with castor wheels 321 or some other fitting that minimizes traction with the floor or supporting horizontal surface. A plurality of triangular-shaped horizontal panels 108 are suspended between and engaged to members 103. Regarding operation, due to the traction-minimized contact with the floor, the gravitational downward pull of static loads on unit 320 automatically generates a continuous spreading force that rotates members 103 further outwards from the vertical axis for effective stressing of panels 108, so long as the framework's static weight exceeds the dynamic suspended weight between members 103, as will be trade understood. If heavier dynamic loads are anticipated, unit 320 can be modified by increasing the load at apex 211. This can be achieved either directly or indirectly by linking horizontal panels 108 to apex 211, so as to capitalize on dynamic loads thereby enhancing the framework's spreading movement. This will be discussed later in FIG. 41. Furthermore, note that as the pyramid's apparent base expands, while upward faces undergo proportionate horizontal expansion, vertical height decreases and should be anticipated and planned accordingly. Also, note that truncated pyramid-shaped or frustum frameworks operate similarly except that upward faces do not expand proportionately which should be anticipated in panel dimensional designs, as will be trade understood.

FIG. 23 of Flared Leg Unit 330, illustrates another example of gravitational framework horizontal expansion. Although operationally similar to the previous unit 320, unit 330 is structurally different with two horizontal faces 101, the upper face 101*b* being rigid, and a contrasting overall right rectangular prism-shape except for the flared legs. Specifically, members 103, which are hingedly interconnected to face 101*b* such that rotation is confined to and from the vertical axis, have at least sloped bottom portions 331, away from the vertical axis, with castor wheels 321 at member ends 104*a*. Note that besides gravity spreading expansion, the flared legs provide increased vertical stability and reduced tendency towards parallelism. As in the previous unit 320, the relationship between unit 330's framework static weight and the dynamic suspended weight is critical and may require a similar method of increasing or redistributing dynamic loads to face 101*b* in order to enhance expansion pressure.

In sum, FIGS. 22 and 23 are just two examples of the numerous possible gravity spreading configurations within the scope of the sixth embodiment. Key criteria for the sixth embodiment include a) outward sloped members 103 or at least bottom-sloped portion from the vertical axis, b) hinged interconnection of upward members 103 to apex 211 or upper face 101*b,* c) no fixed-dimensioned cross members below apex 211 or upper face 101*b,* and d) traction minimizing fitting for member lower ends 104*a* like castor wheels, Teflon® pads or other suitable trade-knowledgeable device. Note that although gravitational force serves to induce horizontal panel stress, frameworks can be fitted with dedicated locking devices to absolutely prevent framework contraction, such as one-way ratchet hinges or rigid braces between members 103 once optimal expansion has been achieved.

Embodiment 7:

FIGS. 24 to 28 illustrate the seventh embodiment, namely frameworks that incorporate a combination of methods to achieve framework expansion. FIG. 24 of Out-Fold Vertical Unit 340 is shown in stick format without storage system to illustrate the combination of gravity spreading and folding action to achieve framework expansion. Unit 340 is similar to In-Fold Vertical Unit 290 except that upward members fold outwards, not inwards. In Unit 340, first position is when members 103 are substantially straight and second position is when members 103 are folded outwards from the vertical axis sufficiently to stress engaged hypothetical horizontal panels. Generally speaking, if the framework's static weight exceeds the suspended dynamic shelf weight, then members 103 will tend to be continuously pressured to expand further outwards from the vertical axis. This expansion movement can be augmented in numerous ways, including: a) by directly weighting the framework's upper face 101*b,* b) by linking shelves 108 indirectly to face 101*b* via hypothetical Y-network 111 as shown in FIG. 1 or other suitable method, or c) by contracting the distance between unit 340's upper and lower faces, 101*b* and a respectively, such as with one or more cable/turnbuckle arrangements. Additionally, joints 261 can be fitted with a one-way ratchet device (unshown) or other suitable progressive locking device to maintain the desired second position. Furthermore, note that Unit 340 provides 2-way horizontal stressing but decreases in height so that dimensions of optional non-horizontal panels, if employed, should anticipate this decrease accordingly or employ alternative vertical stressing methods.

FIG. 25 of Wedge Base Unit 345, shown in contracted position, illustrates the combination of gravity spreading and directional guiding methods to achieve 2-way horizontal expansion. Unit 345 has two horizontal faces 101 with the base 101*a* in this case being three-dimensional and frustum-shaped in the form of a wedge base 346 having tracks 151, or other suitable directional guiding device, along the sloping lateral edges 347 toward base corners 132. Upward member lower ends 104*a* are compatibly shaped to slideably and hingedly interconnect with track 151. Member upper ends 104*b* are hingedly interconnected to upper horizontal face 101*b* which is dimensionally fixed. Regarding operation, as dynamic loads are applied to the unit's hypothetical storage system, gravity forces upward members 103 to slide down and outwards from the vertical axis along track 151 for effective horizontal expansion and stressing. Tracks 151 and member ends 104*a* can optionally be fitted with a suitable progressive locking device to ensure the desired lateral position is maintained. Note that alternative three-dimensional bases are acceptable, whether frustum, pyramid, or cone-shaped, providing that they have outwardly sloping edges 346. Furthermore, note that the angle of contact between member bottom ends 104*a* and edge 346 must be greater than 90° to initiate automatic gravity spreading action. The principle established here also would work if the unit were inverted such that wedge base 346 served as the upper horizontal face, thus forcing members 103 to rotate outwards. Finally, note that this illustration demonstrates the principle that when a framework has two horizontal faces 101, one that expands and one that is dimensionally fixed, upward members 103 must be hingedly interconnected to both horizontal faces.

FIG. 26 of Vertical Cylindrical Unit 350 illustrates the combination of spring and elongation devices to achieve 2-way horizontal expansion. Specifically, unit 350's cylindrical leaf spring 351, i.e. an infinite number of elongated, vertical members 103 laterally interconnected in a discontinuous cylindrical pattern, provides the framework. Largely circular-shaped horizontal panels 108 are engaged via clips 352 which are attached around the panel's perimeter, that slidably engage circular track 353 on the inside of spring 351. A plurality of elongated, discontinuous horizontal members 171, which are adjustably bridged together via bi-threaded rods 201, interconnect the discontinuous ends of spring 351, thus providing contraction for panel engagement and controlled, adjustable multi-directional horizontal expansion.

FIGS. 27*a* and 27*b* of Telescoping Pyramid Unit 360 show two views, in fully expanded and contracted states, that demonstrate a combination of gravity spreading and elongation methods to achieve not only 2-way horizontal but also vertical expansion. Unit 360 has the same gravity spreading design as Unit 320 in FIG. 22 for horizontal expansion, except that upward members 103 are telescoping which allows vertical expansion of optional non-horizontal panels such as interior vertical panels 115. Because panels 108 are engaged to the lower portion of each telescoping section 361, Unit 360 can be horizontally and vertically collapsed without panel disengagement, as shown in FIG. 27*b,* for shipping and handling ease.

FIG. 28 shows in contracted position Out-Swing Corner Unit 370 and illustrates the combined use of folding and directional guiding devices for horizontal expansion. The largely solid, planar and rectangular-shaped horizontal faces 101 have ¼-circle cutouts 371 at each corner 132 such that the radius centerpoint 372 is on the perimeter edge and the arc intersects corner 132. ⅛-circle pie sections 373 to which elongated upward members 103 are interconnected, are hingedly interconnected to radius center-points 372 and slideably interconnected to the inside arc of cutouts 371. Regarding operation, applied force rotates pie sections 373 45° towards corner 132 until a snap detent, or other suitable locking mechanism (unshown), locks the framework in extended horizontal position. Clearly, these articulated planar faces could alternatively be used at any horizontal level.

In sum, FIGS. 1 to 28, 46 and 47 portray varying types of dimensionally expandable frameworks that demonstrate embodiments 1 to 7 including direct placement, directional guiding, elongating, spring, folding and gravity-spreading methods, and combinations thereof. Clearly, an infinite number of alternative configurations are acceptable within this invention's scope, providing that the framework:

a) is a rigid, compatibly shaped structure from which to suspend a flexible storage system under tensile stress, b) is at least horizontally expandable such that at least the key sections of support members, which are fixedly engaged by those panels which in turn are fixedly engaged to the framework at two or more opposing points, move outwards from the vertical axis (i.e. as opposed to panels that are adjustably engaged which would provide an alternative stressing option), c) is vertically expandable, if and when non-horizontal panels are employed that are fixedly engaged at opposite ends and cannot be stressed by gravity-induced, adjustable engagement or other stressing methods, such that at least the key sections move outwards from the vertical axis or interior centerpoint, and d) can be substantially locked into this expanded position so as to effectively maintain panel stress and rigidity.

The following are a few additional pertinent notations. First, the corollary of framework contraction is consistent with this invention, namely that a framework can be dimensionally contracted, engaged with a storage system and de-contracted for effective panel stressing. Second, the framework should be devoid of any rigid, fixed-dimensioned support members that would prohibit either horizontal or vertical expansion if desired, except as optional bracing supports after expansion to maintain panel stress. Third, the framework's range of expandability should be compatible with the elasticity range of selected panel materials under anticipated static and dynamic loads. Fourth, if a framework comprises two horizontal faces and only one expands, then upward members must be hingedly interconnected to both horizontal faces, as will be trade-understood. Finally, in situations where the storage system not only uses gravity vertical stressing but also requires horizontal traveling engagement to a planar-like support member, then the engagement device must allow both vertical and horizontal mobility in a grid-like tracking engagement pattern.

Embodiment 8:

Unlike embodiments 1 to 7 that involve dimensionally reconfigurable frameworks that expand and contract, embodiments 8 to 11 employ alternative approaches to generating tensile stress to storage panels that do not require framework expansion. FIGS. 29 to 31 illustrate the eighth embodiment of this invention, namely the engagement contraction method of stressing where a dimensionally contractible engagement device is employed to adjustably draw engaged panels closer to the framework so as to remove the slack and initial elasticity.

FIG. 29, a top plan view of Roller Reefing Frame 380's typical shelf construction uses a reefing method to in effect lessen the exposed panel area. Specifically, frame 380 which happens to be rectangular-shaped and employs roller reefing devices 381 as part of the framework. Elongated horizontal members 171 have 45° beveled gears 382 near ends 172 which interconnect with upward members 103 through keyhole sockets 383 that allow rotation of members 171 about their longitudinal axis. Adjacent members 171 are effectively meshed together for simultaneous rotation. One of the members 171 is provided with an extension shaft 384 that penetrates through member 103 and is fitted with ratchet-wheel 385 that progressively interlocks with pawl 386 mounted to the exterior side of member 103. Horizontal panels 108 are engaged to members 171 through longitudinal slots 387 that allow perpendicular slippage. Regarding operation, applied force rotates crank handle 388, which is removably affixed to the end of shaft 384, in a clockwise direction to tensilely stress engaged panel 108 in perpendicular side-to-side directions. Note that there are numerous alternative configurations of this roller reefing device, such as diagonal corner-to-corner horizontal reefing, vertical reefing etc. Furthermore, note that reefing methods other than the roller type are acceptable such as lashing or tie-downs so long as excess slack and elasticity of panels can be eliminated. Finally, note that the reefing device need not be an integral structural component of the framework, but rather could be located within the panel itself or anywhere in between, as will be understood by those in the trade.

FIG. 30 of Draw Latch Engagement 390 is another example of an engagement contraction device that illustrates the eighth embodiment. Tension draw latches 391 are mounted onto horizontal members 171 with pivot-base bracket 392. Draw hook 393 pivotly extends from bracket 392 and engages complimentary-shaped latch hook 394 mounted on reinforced panel corners 123 of shelves 108. Lever 395 is rotatably connected to bracket 392 as well as draw hook 393, which has an adjustable threaded section 396 to provide adjustability in panel stressing. Tension draw latches 391 can be employed in many positions on both framework and panels, including side-to-side, diagonal corner-to-corner and vertically. Also, numerous alternative trade-knowledgeable engagement devices that mechanically contract or otherwise can be used instead of draw latches, including turn buckles, pulleys, etc. Clearly, contracting engagement devices need not be restricted to use on dimensionally fixed frameworks.

FIG. 31 of Reinforced Panel Corner 400 is another example of an adjustable engagement contraction device. All engagement devices must necessarily comprise at least two complimentary interlocking parts 404, a first part 404*a* that is connected to the framework and a second part 404*b* that is attached to the panel. In this case, the second part 404*b* incorporates a series of identical progressive settings or set holes 154 on corner tab 403. The complimentary-shaped interlocking first part 404*a* extends from the framework and can be engaged to any one of the identical set holes 154, depending on the desired level of tensile stress. Note that progressive settings 154 should ideally be of sufficient number to provide an acceptable range of adjustability, from macro to micro adjustments depending on the fabric type, desired tension, anticipated loads, etc. Although FIG. 31 shows a simplified linear arrangement of settings 154, an alternative would be to have staggered or overlapping positions for greater adjustability. Furthermore, note that there is an infinite variety of trade-knowledgeable interlocking parts that could be alternatively used here. Clearly, the direction of engagement can easily be reversed.

In sum, FIGS. 29 to 31 are just a few examples of viable engagement contraction devices within the eighth embodiment. Other sailing analogies include the use of block and halyard for vertical contraction and outhaul for horizontal contraction, each being fully adjustable and employing a cleat or other locking device to maintain the desired contracted tension. These and many other trade-knowledgeable engagement contraction devices are within this invention's scope, providing that:

a) the panel is engaged securely under anticipated loads,
b) the panel can be adjustably tensioned via contraction of the device and
c) the device can be effectively locked to maintain the desired tension.

Embodiment 9:

The ninth embodiment of this invention achieves tensile stressing by the gravity-induced pressure of static and dynamic loads. As discussed earlier in FIG. 1, non-horizontal panels can be vertically stressed providing the panel top is fixedly engaged, either directly or indirectly to the framework and that at least the panel's bottom corners are travelingly engaged to a largely vertical support member to allow downwards stretch and extension.

FIG. 32 of Gravity Stressing Frustum Unit 405 illustrates one example of a class of frameworks than can achieve gravity-induced 2-way horizontal as well as vertical stressing. In this case, the framework is dimensionally fixed, comprised of elongated perimeter support members in a frustum-shaped configuration, with upward members 103 sloped outwards from the top. Storage system 107 is compatibly frustum-shaped and is exclusively travelingly engaged to sloped members 103 with no fixed engagement as in FIG. 1 with closed sleeve 116. Regarding operation, applied weight encourages travel engagements, in this case open sleeves 116, to stretch and extend downwards and outwards along sloped members 103 to effectively stress horizontal and non-horizontal panels. Note that the downward slippage of sleeves 116 along members 103 may require assistance if excessive friction prevents automatic slippage, so as to insure proportionate panel stressing. Furthermore, note that the lower ends of sleeves 116 can be optionally fitted with a suitable locking device to prevent any unwanted upwards retreat along members 103, particularly in configurations with less pitch.

Embodiment 10:

The tenth embodiment of this invention generates tensile stress via panel shrinking after engagement to the framework. Although not included in the drawings section, storage furniture reflecting this tenth embodiment would obviously comprise storage panels of a material that was not only flexible, tensilely strong and substantially inelastic but also shrinkable, permanently or nearly so, from one or more shrink treatment processes known to the trade, including heating, cooling, wetting, drying, chemical or other shrink-inducing agents. Regarding operation, shrinkable panels should be engaged by at least their corners to the framework before shrinkage. Note that, although continuous fixed engagement along panel perimeter edges would inhibit proper shrinkage and is therefore undesirable, intermittent fixed engagement or slideable engagement with proportionately equal slack in between is acceptable. After shrinkage, engagement of remaining panel edges is also acceptable. Also, note that use of adjustable engagement devices between panel and framework is desirable for fine tuning panel stress or compensating for residual stretching, if any.

Embodiment 11:

The eleventh embodiment of this invention achieves removal of slack and initial elasticity by tensilely prestressing panels before engagement. Although not illustrated, there are three basic approaches to prestressing panels: a) multi-directional panel prestressing and simultaneous engagement directly to the framework, b) initial point engagement and subsequent progressive steps of prestressing and engagement until panel is fully stressed and engaged, or c) prestressing panel to a two-dimensional independent frame and subsequent mounting of frame to framework. Either way, engagement devices for prestressed panels should obviously avoid any slippage during the engagement process or later under anticipated dynamic loads. As in the previous embodiment, use of adjustable engagement devices for prestressed panels is desirable for fine tuning stress levels. Note that the fixed dimensions of the framework should equal or exceed the fully stressed dimensions of the storage system. Furthermore, it is not necessary to stretch each panel individually if the storage system is three-dimensional and perimeter-defined. Exterior corners can be prestressed outwards from the interior centerpoint and engaged to the framework. In this manner, many panels will be stressed indirectly via "piggyback stressing," which also applies to all tensile stressing methods.

Embodiment 12:

FIGS. 33 to 37 illustrate the twelfth embodiment, namely the combined use of two or more tensile stressing methods to achieve multi-directional panel stress. FIG. 33 of Side Placement Unit 410 illustrates the combination of prestressing and direct placement method. Unit 410's two upward members 103, which are essentially fixed-dimensioned solid planes, require engagement of prestressed panels, both horizontally fore-aft and vertically. Side-to-side horizontal stressing of panels 108 is accomplished by lateral direct placement of planar members 103 and locked interconnection with floor and ceiling.

FIG. 34 of Elongating Cantilevered Unit 420 illustrates the combination of prestressing and framework elongation. Unit 420's framework has a rectangular, vertically oriented upward face 102 that comprises two upward members 103 that are elongated, diagonally sloped, intersecting, and discontinuous between intersection point 181 and ends 104 with an adjustable bridging mechanism 182 in between, in this case via threaded rods 201. Four horizontal members 171 are rigidly and perpendicularly interconnected and cantilevered from ends 104. Panels, horizontal 108 and vertical side 110, must be prestressed horizontally fore-aft before engagement to members 171. However, elongation of bridging mechanisms 182 provides both horizontal side-to-side and vertical panel stress.

FIG. 35 of Pivot X-Frame Unit 430 illustrates the combination of prestressing and folding expansion. Unit 430's two horizontal faces 101, which each comprise two horizontal members 171 that are elongated diagonally and rotatably intersecting at point 181, are interconnected by four upward members 103 between corresponding member ends 172. Panel corners 123*a* and *b* are engaged to the front lateral edges of X-frame 430. As panel corners 123*c* and *d* are prestressed to engage the back lateral edges, the X-frame rotates about its vertical axis simultaneously forcing side-to-side horizontal expansion for effective 2-way horizontal panel stress overall. Note that the horizontal fore-aft dimension of stressed panel 108 must not exceed the corresponding framework dimension.

Figure 36B:
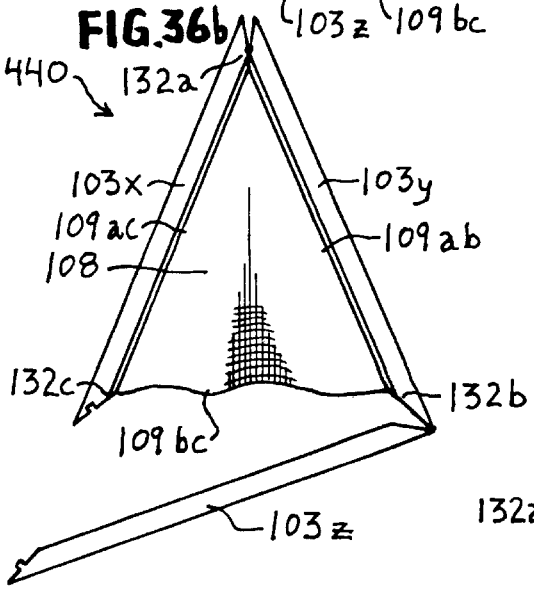
Figure 36C:
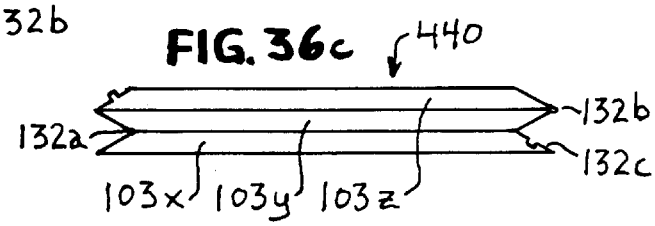

FIG. 36 of Hinged Wall Unit 440, which shows three top plan views: a) fully expanded, b) partially contracted and c) folded, further illustrates the combination of prestressing and folding expansion. Unit 440 comprises three planar-like upward members 103*x, y* and *z,* whose adjacent lateral edges are internally hinged at corner 132*a,* externally hinged at corner 132*b* and lockably interconnectable at corner 132*c*. Compatible, triangle-shaped horizontal panels 108 are engaged by their corresponding corners 123*a, b* and *c,* to members 103*x* and *y* at corners 132*a, b* and *c*. Panel borders 109*ac* and *ab* are necessarily prestressed for engagement. As applied force moves members 103 such that corners 132*a b* and *c* become equally 60°, panel border 109*bc* is proportionately stressed. Obviously, at least one of members 103 has openings for shelf access from the outside. Note that in FIG. 34*c,* unit 440 can be folded substantially flat with or without engaged panels 108 for shipping and handling ease.

FIG. 37 of Telescoping Standard Unit 450 further illustrates the combination of prestressing and framework elongation. Unit 450 is similar to unit 230 in FIG. 13, except that in this case horizontal face 101 consists of one planar, triangularly shaped, fixed-dimension horizontal member 171. Accordingly, storage grid 233 should first be prestressed horizontally and engaged to the corresponding corners of member 171 and then stressed vertically by elongation of telescoping, upward member 103.

In sum, FIGS. 33 to 37 represent only a few of the infinite number of framework configurations within the scope of this invention that can effectively employ the combination of two or more tensile stressing methods to achieve multidirectional panel stress.

Embodiment 13:

FIGS. 38 to 40 serve to illustrate the thirteenth embodiment of this invention, namely intrapanel flexible reinforcement that increases storage panel load-bearing capacity by redistributing stresses from lesser to greater load-bearing points within the panel plane.

FIG. 38 shows Fixed-Network Rectangular Shelf 460 which illustrates a corner-engaged rectangular shelf that features linear fixed suspension by employing a broad-based network of fixed fiber intersection points. Specifically, elongated fibers 461 radially emanate from panel corners 123 intersecting, converging and attaching with each other forming a web-like linear fixed-suspension network 462 of fixed fiber intersection points 463, each of which is fixedly tethered to three or more distinct greater load-bearing points, such that convergence angles 114 at points 463 are not greater than 180°. Note that optional fiber bridge 464 between two opposing dual-tethered points 465 can effectively serve as the third tethered fiber to form additional fixed points 463. Regarding operation, once shelf 460 is 2-way tensilely stressed, randomly placed dynamic loads will rest on or substantially near a fixed point 463, thus helping to redistribute the load more directly to the greater load-bearing corner-engagement points. Note that if shelf 460 were engaged continuously along two opposing borders, instead of corner-engaged, then fibers 461 could emanate from anywhere along these engaged borders. Obviously, numerous other fixed-suspension network configurations are feasible within the scope of this invention, so long as points 463 are fixedly tethered and achieve broad coverage of shelf 460. Note that linear network 462 can be used either as a) a panel by itself or b) a reinforcement overlayer secured to a more traditional cross-woven or non-woven base panel via sandwiching or other suitable attachment method. Furthermore, although shelf 460 was designed for horizontal storage usage, clearly non-horizontal usage is equally feasible.

FIG. 39 of Fixed-Network Triangular Shelf 470 is identical to shelf 460 except triangularly shaped and suitable for use in three-sided frameworks requiring corner engagement.

FIG. 40's front elevation view of stabilized-Network Vertical Panel 480 illustrates another example of intrapanel fiber reinforcement, in this case using linear v-suspension and gravity for panel stability. In this particular example, it is assumed that vertical panel 110 is continuously engaged by its opposite borders via sliding sleeves 116, or other suitable continuous traveling engagement method, that are fixedly engaged at their upper end, in this case via hanging strap 125. Elongated fibers 461 slope downwards, in this case at 45° in parallel fashion from side borders between lower and upper panel corners 123*a* and 123*b,* respectively. Additionally, fibers 461 radiate outwards from upper panel corners 123*b,* progressively sloped from 45° to nearly horizontal. The net result of these intersecting and inter attaching fibers 461 is linear stabilized-suspension network 481 of stabilized fiber intersection points 482, each of which is stably tethered to two distinct greater load-bearing points such that upper convergence angle 114*a* is less than 180°. Regarding operation, once panel 480 is 2-way tensilely stressed, randomly placed downward dynamic loads will rest on or substantially near a stabilized point 482, thus helping to redistribute the load directly to the greater load-bearing, side-engagement points. As mentioned earlier, sliding sleeves 116 allow downward dynamic loads to automatically stress panel 480 vertically. V-suspension, unlike the previous two examples of fixed-suspension, relies on this downward force of dynamic loads to achieve enhanced planar stability.

Note that this linear V-suspension configuration can be substantially accomplished with the use of traditional cross-woven fabric, cut on the bias so that the weave pattern is diagonally oriented. Only points above the 45° sloped upper corner-intersecting fibers would remain untethered to frame-engaged side points. Furthermore, note that if side engagement method was intermittent instead of continuous as in sliding sleeve 116, then the reinforcing fibers would have to radially emanate from these intermittent side-engaged points. Finally, note that if continuous fixed side engagement was employed, then panel 480 would have to be vertically prestressed before engagement, resulting in a fixed-suspension network similar to FIG. 38, as will be understood by those in the trade.

Referring to FIG. 31 again, Reinforced Panel Corner 400 also serves to illustrate a variety of intrapanel reinforcement devices designed to enhance the load-bearing capacity of a traditional cross-woven fabric panel, shown here as corner-engaged, by independent load redistribution methods. Hemmed borders 109 strengthen the exposed, unengaged perimeter of panel 108. Belting 401, or other suitable flexible reinforcing material, is attached around the perimeter border not only for further strengthening but also to help the lateral transfer of loads along the border towards the greater load-bearing engaged panel corners 123. Parallel laminate coatings 402, in this case clear vinyl, sandwich and effectively interlock the cross-weave pattern of panel 108 so that point loads are shared and redistributed to adjacent fibers. Corner tab 403, in this case made of leather or other relatively heavier, stiffer material, is attached to corner 123 to help diffuse loads across a greater number of fibers within corner proximity. Note that the load redistribution methods discussed above can be employed independently or in various combinations to achieve different levels of enhanced load-bearing capacity.

In sum, FIGS. 38 to 40 illustrate the thirteenth embodiment which involves intrapanel flexible reinforcement devices to redistribute loads across the panel surface for more equitable load distribution and thus greater load-bearing capacity of storage panels. Importantly, note that reinforcement fibers can be employed as an internal means of adjusting panel tension, rather than relying on external adjustment methods such as engagement contraction, etc. Specifically, independent fibers can be used to travel in strategic directions within the panel's plane via elongated open-ended pockets; these fibers can be tensioned and locked, via button cleats or other suitable locking device, to increase the host panel's overall tension. Clearly, these internal tensioning fibers can alternatively extend beyond the panel's external borders for accessibility and control reasons.

These and numerous other flexible, intrapanel reinforcement configurations fall within the scope of this invention, providing that they: a) are incorporated within the panel or its extended plane, b) comprise flexible, tensilely strong and substantially inelastic material, c) effectively transfer weight from lesser to greater load-bearing areas on the panel and d) result in overall greater strength and structural rigidity under 2-way tensile stress.

Embodiment 14:

FIGS. 41 to 45 and 47 to 49 serve to illustrate the fourteenth embodiment of this invention, namely extrapanel flexible reinforcement that increases storage panel capacity by redistributing stresses from lesser load-bearing points on to greater load-bearing points outside the panel's plane.

FIG. 41 shows Center-Supported Pyramid 500, similar to FIG. 22 except that pyramid 500 employs plumb suspension cable 501 that is adjustably engaged to and vertically suspended from apex 211, intersecting and attaching to all underlying panels 108 in this case via button joints 502 or other suitable manner. Cable 501, which comprises a strand of flexible, tensilely strong and substantially inelastic fibers. This modified configuration of unit 320 allows a significant portion of dynamic load weight on shelves 108 to be transferred to apex 211, thereby enhancing the framework's expansion movement and preventing panel center sagging.

FIG. 42 of V-Suspended System 510 features planar Y-network 111, which is identical to that illustrated in FIG. 1 except that sloped panels 112 are engaged directly to the framework via upper panel corners 123*b*. System 510 employs planar v-suspension, which is conceptually similar to linear v-suspension, to achieve vertical and lateral stability as pressure stresses vertical 115 downwards either from dynamic loads or other direct stressing method. Regarding operation, the planar v-suspension helps redistribute load forces on or near vertical 115 to the framework. Note that although Y-network 111 is shown as symmetrically shaped, alternative asymmetrical configurations, modifications and directional orientations are acceptable providing that a) upper convergence angle 114*a* is less than 180°, b) stabilized line 113 is weighted and c) sloped panels 112 are effectively engaged, directly or indirectly, to the framework.

FIG. 43 shows Wide Span System 520, which uses a modified version of planar v-suspension to allow greater distances between upward members 103 while maintaining near-rigidity of horizontal panels 108. As discussed earlier in FIG. 1, an infinite number of secondary stabilized lines 113*b* and vertical panels 118 can be incorporated to achieve enhanced rigidity of wide-span shelves 108.

FIGS. 44*a* and *b* of Sloped Library Unit 530 features not only stabilized but also planar fixed suspension and shows the unit in a fully expanded and loaded status as well as folded position, respectively. Note that unit 530's framework consists of two upward members 103 and two horizontal members 171 that are all planar-like. Members 171, which are hingedly interconnected to members 103, are discontinuous in a fore-aft direction at folding joint 261, to allow contraction and expansion of members 103 to and from the vertical axis. Accordingly, storage system 107 is effectively stressed in this case by horizontal fore-aft prestressing before engagement to members 103 followed by the forced unfolding of members 171 to a substantially straight and locked position. Fixed-suspension lines 531 are formed by the convergence of three or more "fixed" framework-engaged panels whose convergence angles 114 are no greater than 180°. Regarding operation, fixed lines 531 are essentially rigid, both vertically and laterally, with or without dynamic loads. However, stabilized lines 113 become near-rigid only with dynamic loading. Note that optional use of a panel bridge, unshown, between two opposing v-suspended, stabilized lines would effectively form another fixed suspension line 531. It should also be noted that sloped panels 112 can theoretically be effectively 2-way stressed either horizontally, vertically, slopingly or some combination thereof, as will be understood by those in the trade. Finally, note that both planar v-suspension and fixed suspension serve to inhibit any potential tendency toward parallelism for all frameworks.

FIGS. 47 to 49 are additional examples of extrapanel reinforcement featuring sloped panels 112. As illustrated in FIG. 48, opposing sloped panels 112*a* and *b* converge at fixed suspension line 531, which results from the intersection of panel bridge 571. This rather simple configuration of fabric panels largely prevents parallelism movement. In FIG. 49 where system 107 is engaged exclusively to horizontal members 107, opposing sloped panels 112*a* and *b* have a similar effect as the previous unit in preventing parallelism movement of the framework. Theoretically, any storage system whose component panels have 0% elasticity and comprise at least two opposing sloped panels 112 whose ends are fixedly engaged to either the framework or a fixed suspension line 531 will prevent any parallelism movement. In reality, since no fabrics are 100% inelastic, opposing sloped panels should ideally be significantly different in slope to achieve this anti-parallelism effect, as will be trade-understood. Note that in addition to the structural benefits, sloped panels provide certain storage advantages particularly if they interact at right angles, as in FIGS. 44 and 47.

FIG. 45 of Suspension Braced System 540 illustrates shelving that is extrapanelly reinforced via suspension braces. Specifically, suspension brace panel 541 is largely vertically oriented and has three perimeter borders, including a horizontal border 109*a*, an upwardly disposed border 109*b* and a diagonal border 109*c*. Border 109*b* is engaged to member 103 upwardly from panel 108's engagement point. Border 109*a* is attached to panel 108 from corner 123 along a line of lesser load-bearing points. Regarding operation, when effectively stressed, panel 541 helps redistribute downward load forces on panel 108 directly to the framework. Note that the optional use of brace panels 541 on the underside of shelves would serve to inhibit any potential upward deflection of panel 108.

In sum, FIGS. 41 to 45 and 47 to 49 illustrate various forms of extrapanel flexible reinforcement, the fourteenth embodiment of this invention. Clearly, there are many alternative configurations that would fall within the scope of this invention, providing that a) the reinforcement material is flexible, tensilely strong and substantially inelastic, b) the device interconnects lesser load-bearing points on with greater load-bearing points outside the panel's plane and c) the reinforcement device is effectively stressed along with the rest of the storage system.

SUMMARY OF THE INVENTION

To summarize in the simplest terms, the present invention establishes a unique concept in storage furniture that combines a rigid structural framework that engages a compatibly shaped storage system, which is composed of flexible panels that are tensilely and adjustably stressed in at least two largely perpendicular directions so as to remove the slack and initial elasticity for "near rigid" storage surfaces. As detailed in the previous section, the invention encompasses a wide variety of options within each of its component parts:

1. Any framework is acceptable, whether it has four or more "apparent" faces, whether it has one or more horizontal faces, whether its support members are elongated or planar-like, whether it is dimensionally fixed or variable, etc., providing the framework:
   - is rigid and compatibly shaped with the storage system.
   - can maintain substantial rigidity under anticipated panel stress conditions.
2. Any storage system is acceptable, whether it comprises horizontal panels exclusively, sloped panels exclusively, or a combination of horizontal and non-horizontal panels, whether the panels are woven fabric or non-woven sheet material, whether the panels are generic or flexibly reinforced intrapanelly or extrapanelly, etc., providing the storage system:
   - is made of flexible, tensilely strong and substantially inelastic materials within the context of anticipated usage.
   - has sufficient reinforcement and load-bearing capacity for anticipated static and dynamic loads.
3. Any engagement device is acceptable, whether it is point, intermittent or continuous engagement, whether it is perpendicularly fixed or adjustable, whether it is parallelly fixed or traveling, etc., providing the engagement device:
   - can properly align, suspend and integrate the storage system with the framework.
   - can effectively transfer anticipated loads from the storage system to the framework.
4. Any panel tensile stressing method is acceptable, whether achieved by framework expansion, engagement contraction, gravity-induced, panel shrinking, panel prestressing, or some combination thereof, etc., providing the tensile stressing method:
   - effectively removes the slack and initial elasticity without exceeding the elastic limit of the panels under anticipated loads. p1 effectively stresses both horizontal and non-horizontal panels in at least two largely perpendicular directions.
   - allows sufficient adjustability in stress levels to accommodate varying fabric elasticities, anticipated dynamic loads and residual panel elasticity and stretching.
   - can be effectively locked to substantially maintain the desired tensile stress.
5. Any applied force is acceptable, whether manual or mechanical, whether hydraulic or pneumatic, whether electromagnetic or gravity-induced, whether atmospheric or chemical-induced, or whether a combination of forces thereof, etc., providing the applied force:
   - is easily manageable and controllable.
   - generates sufficient pressure to achieve the required tensile stressing for anticipated static and dynamic loads.
6. Finally, regarding adjustability of panel tension, there are numerous options as discussed, including any one or combinations of adjustment methods summarized below:
   - external adjustment via framework expansion/contraction,
   - external adjustment via engagement contraction/expansion,
   - internal adjustment via re-prestressing panels,
   - internal adjustment via intrapanel reinforcement fiber tensioning, and
   - internal adjustment via gravity-induced panel stretching.

RAMIFICATIONS & SCOPE OF THE INVENTION

The majority of the detailed description section focuses on establishing the fundamental principles of this invention. This section offers a few brief, tangential design considerations. First, the framework should ideally, but not necessarily, be comprised of either dismantable or foldable component parts to maximize knockdownability and portability benefits. Similarly, the storage system should be disengageable from the framework as well as foldable or rollable for compact packaging and storage. Second, there are numerous advantages in having a modular design to this storage furniture. For example, modularity would allow units to be stackable both vertically and laterally for additional storage space as needed. Modularity in storage systems would allow interchangeability within a given framework for replacement purposes, alternative fabric selection, contrasting compartmentalization schemes, etc. Furthermore, panels and engagement systems can be modular-designed to give maximum flexibility to reconfigure the internal panel layout for customized storage space. Third, the storage furniture can be abundantly accessorized for specific end usages. For example, the exterior of the unit can be equipped with any manner of shades, blinds, curtains, hinged doors, rigid panels, etc. for privacy, dust protection, security reasons and the like. Furthermore, the interior can be accessorized with electric lighting, sliding drawers, panel bins, cantilevered storage appendages and numerous other trade-knowledgeable manners. And fourth, storage furniture of the present invention can be reinforced with increasingly less flexible and more rigid materials to achieve ever diminishing returns of increased load-bearing capacity, strength and rigidity, providing the principle of 2-way panel stressing is maintained. This recognizes the fact that rigidity is a relative term, dependent on the material type, usage context and anticipated loads. FIG. 46 illustrates Hybrid Storage System 550 that incorporates two examples of more rigid stiffening devices. Specifically, horizontal battens 553 inserted into batten sleeves 554 tend to increase the rigidity of horizontal shelves 108. Additionally, vertical insertion board 555 inserted into board sleeve 556 serves to increase the rigidity of vertical side panel 110 in order to better support poll U-bracket 557 and closet poll 558. Clearly, numerous other stiffening methods known to the trade can be used to enhance rigidity, albeit in ever-diminishing increments.

Regarding the scope of this invention, this storage furniture is designed primarily for horizontal storage shelf or bin application. Clearly however, furniture of the present invention if directionally reoriented has equal applicability in terms of providing sloped as well as vertical storage surfaces or bins. For example, 2-way stressed panel vertical bins or stalls can be used for upright storage of elongated objects like folded umbrellas, sporting equipment, etc. The concept of a stressed-panel "vertical shelf" against which to lean or affix objects has unlimited usage. Beyond this, many of the flexible reinforcement principles established in this invention have clear and immediate application to wall-mounted, closet-poll suspended and other dependent-type storage systems.

Finally, the scope of this invention includes not only consumer-oriented storage furniture for residential use, but also includes viable storage applications for commercial, institutional and industrial markets. For example, lightweight, portable storage units would be ideally suited for temporary medical facilities, military field operations, camping facilities, NASA space applications and beyond!

Having thus described in detail the preferred embodiments of the present invention, persons skilled in the art will be able to modify certain of the illustrated structures and to substitute equivalent elements for those disclosed while continuing to practice the principles of the invention; and it is, therefore, intended that all such modifications and substitutions be covered as they are embraced within the spirit and scope of the appended claims.

I claim:

1. An article of storage furniture comprising in combination:

a framework comprising a plurality of interconnected support members including at least one largely horizontal support member and a plurality of upwardly disposed support members, the configuration of said interconnected members defining at least four generally planar faces comprising at least one largely horizontal face to serve as a base and at least three upwardly disposed faces, adjacent pairs of which converging and forming the apparent lateral edges of said framework;

a storage system comprising one or more horizontal panels or shelves and optionally one or more non-horizontal panels that interconnect said shelves, the material of said panels being flexible, tensilely strong and substantially inelastic, the overall shape of said storage system being dimensionally compatible with said framework;

means for engaging said system to said framework wherein said system is compatibly aligned, suspended and effectively integrated with said framework, said engaging means comprising at least two complimentary interlocking parts, a first part that is connected to said framework and a second part that is connected to said panel;

tensioning means for generating continuous tensile stress in at least two largely perpendicular directions so as to remove the slack and the initial elasticity of said system's panels, whereby said article of storage furniture provides "near-rigid" storage space under anticipated static and dynamic loads thereon placed.

2. The article of storage furniture according to claim 1 wherein said tensioning means is adjustable and comprises a framework expanding means for repositioning at least the key sections of said support members, both horizontal and upward, which are fixedly engaged by those of said panels which have two or more opposing fixed-engagement points, said key sections being repositioned outwards from the interior centerpoint within said framework without compromising its structural integrity, said tensioning means further comprises a forcing means to activate said framework expanding means until said panels are effectively stressed, as well as a locking means for maintaining the desired reposition of said member sections, thereby effectively stressing said engaged storage.

3. The article of storage furniture according to claim 2 wherein said framework expanding means comprises a direct placement means for repositioning those of said support members having at least one of said key sections outwards from said centerpoint.

4. The article of storage furniture according to claim 3 wherein said framework comprises two of said horizontal faces, said upward members being largely vertical, elongated and removably interlocking with said horizontal.

5. The article of storage furniture according to claim 4 wherein said horizontal faces comprise a floor and a ceiling, said upward members are largely vertical and height-adjustable for compression fitting between said floor and ceiling, said panel material being fabric, said storage system further comprises a planar Y-network comprising two sloped panels, the lower ends of which converge, forming an upper convergence angle of less than 180°, and attach along a stabilized line, the upper ends of said sloped panels being engaged to said upward members, said Y-network further comprises an interior vertical panel that suspends from said stabilized line and interconnects the underlying of said shelves, the uppermost plane of engagement of said storage system being vertically fixed, the underlying engagement points all being vertically traveling, whereby outward direct placement of said largely vertical support members effectively stresses said horizontal panels, while gravity-induced downward travel under dynamic loads effectively stresses said non-horizontal panels.

6. The article of storage furniture according to claim 2 wherein said framework expanding means comprises a directional guiding means for slidably interconnecting and guiding movement of those of said support members having at least one of said key sections outwards from said centerpoint.

7. The article of storage furniture according to claim 2 wherein said framework expanding means comprises an elongation means for elongating a plurality of said framework's support members such that said key sections are repositioned outwards from said centerpoint, said elongatable support members being discontinuous and interconnected with an adjustable bridging mechanism, said forcing means to elongate said bridging mechanism, thereby elongating said discontinuous members.

8. The article of storage furniture according to claim 7 wherein said framework has two of said horizontal faces, each comprising one of said elongatable support members consisting of a discontinuous generally circular perimeter member that is horizontally oriented, said upward members interconnecting said circular members, said storage system being engaged to said upward members, whereby elongation of said bridging mechanism increases the circumference of said circular horizontal members as well as the radial distance between said upward members and said centerpoint.

9. The article of storage furniture according to claim 2 wherein said framework expanding means comprises a spring means for providing said forcing means to reposition said key sections outwards from said centerpoint, said spring means being precompressed before engagement of said storage system and free to release compressive energy after engagement, thus simultaneously providing continuous tensile stress.

10. The article of storage furniture according to claim 9 wherein said framework has two of said horizontal faces, said spring means comprises a plurality of vertically oriented concave bow springs serving as all of said upward members which interconnect said two horizontal faces.

11. The article of storage furniture according to claim 2 wherein said framework expanding means comprises a folding means wherein a plurality of said framework's support members are discontinuous with a folding joint in between such that when said folding members collectively travel from a first position to a second position, said key sections are repositioned outwards from said centerpoint until said engaged panels are effectively stressed, said forcing means applied to said folding members to force travel from said first position to said second position, said locking means to maintain said second position.

12. The article of storage furniture according to claim 11 wherein said framework has two of said horizontal faces, said folding members are located within said horizontal faces, each comprising two of said horizontal members that are diagonally oriented, rotatably interconnected at an intersection point and having one of said folding joints between said intersection joint and the horizontal member ends, which are interconnected by said upward members, said storage system being engaged to said upward members, said first and second positions being when said jointed horizontal members are folded and less folded, respectively.

13. The article of storage furniture according to claim 11 wherein said framework has two of said horizontal faces, said folding members are located within said horizontal faces, each comprising at least four of said horizontal members including one rigid, inner planar component and at least three spoke members that are hingedly interconnected to said planar component and radiate towards the apparent corners of said horizontal face, said upward members interconnecting the corresponding exterior ends of said spoke members, said storage system being engaged to said upward members, said first and second positions being when said spoke members are folded and less folded, respectively.

14. The article of storage furniture according to claim 11 wherein said framework has two of said horizontal faces and at least three of said upward faces, each comprising two of said upward members which are spaced and hingedly interconnected by at least two of said horizontal members, which each have one of said folding joints midway, said storage system being engaged to said upward members, said first and second positions being when said jointed horizontal members are folded and less folded, respectively.

15. The article of storage furniture according to claim 11 wherein said framework has two of said horizontal faces each comprising one or more of said horizontal members, said horizontal faces being interconnected by three or more of said upward members, each having one of said folding joints at a common height and having a hinged connection to said horizontal faces such that said joints and hinged connections confine movement of said folding upward members to and from said centerpoint, said storage system being engaged to said upward members, said first and second positions being when said upward members are folded inwards and less folded, respectively.

16. The article of storage furniture according to claim 2 wherein said framework expanding means comprises a gravity spreading means for gravity-induced repositioning of those of said support members having one or more of said key sections, said upward members being interconnected only at the top of said framework by a plurality of hinged connections which confine rotation of said upward members to and from said centerpoint, said upward members having at least a bottom portion that is sloped away from the imaginary vertical axis of said framework, the bottom ends of said upward members being fitted with a traction minimizing means for minimizing traction with the horizontal surface upon which said framework rests, whereby the combined effect of said hinged connections, sloped bottom portion and traction minimizing means along with the gravitational force of static loads causes said upward members to automatically spread outwards from said centerpoint to effectively stress said engaged storage system.

17. The article of storage furniture according to claim 16 wherein said upward members have a constant slope and hingedly converge at an apex, said traction minimizing means being a rolling device to facilitate outward movement, said furniture further having a means of increasing load weight at said apex, whereby outward spreading movement is enhanced.

18. The article of storage furniture according to claim 16 wherein said framework has two of said horizontal faces, the upper of which comprises one or more of said horizontal members, said upward members being largely vertical above said sloped bottom portion, said traction minimizing means being a rolling device to facilitate outward movement, said furniture further having a means of increasing load weight at said upper horizontal face, whereby said sloped bottom portions provide not only a gravity spreading means but also enhanced vertical stability.

19. The article of storage furniture according to claim 2 wherein said framework has only one of said horizontal faces, the bottom ends of said upward members flexibly interconnecting with the apparent perimeter corners of said base, the upper ends of said upward members hingedly converging at an apex, whereby said framework expansion means creates a proportionately equal horizontal expansion of said framework's upward faces and said engaged shelves.

20. The article of storage furniture according to claim 2 wherein said framework comprises two of said horizontal faces, a first horizontal face that incorporates said framework expansion means and a second horizontal face, said upward members having a flexible connection to the apparent corners of said first and second horizontal faces so as to confine rotation of said upward members to and from said centerpoint, whereby said first horizontal faces expansion means creates an outward movement of all of said upward faces.

21. The article of storage furniture according to claim 2 wherein said tensioning means comprises a combination of at least two of the following framework expansion means: a direct placement means, a directional guiding means, an elongating means, a spring means, a folding means and a gravity spreading means for repositioning said key sections outward from said centerpoint so as to effectively stress said engaged storage system.

22. The article of storage furniture according to claim 21 wherein said framework has two of said horizontal faces each comprising one or more of said horizontal members, said horizontal faces being interconnected by three or more of said upward members, each having a folding joint at a common height and a hinged connection to said horizontal faces such that said joints and hinged connections confine movement of said folding upward members to and from said centerpoint, from a first position when said folding members are straight to a second position when said folding members are folded, said storage system being engaged to said upward members and optionally engaged to the upper of said horizontal faces, whereby the combination of both said folding means and gravity spreading means reposition said key sections outwards from said centerpoint to effectively stress said engaged storage system.

23. The article of storage furniture according to claim 1 wherein said tensioning means comprises an engagement contracting means for adjustably drawing said engaged panels closer to said framework so as to remove said slack and initial elasticity, said tensioning means further comprising a forcing means to activate said engagement contraction means until said panels are effectively stressed and a locking means for maintaining the desired contracted position and panel stress level.

24. The article of storage furniture according to claim 23 wherein said engaging means incorporates said engagement contracting means such that said second interlocking part is extended with a plurality of identical progressive settings each of which are complimentary to said first part, whereby panel stress can be adjustably increased or decreased as needed.

25. The article of storage furniture according to claim 23 wherein said engagement contracting means comprises a tension draw latch that engagedly overlaps said framework and said panels, said draw latch comprising a pivot-base bracket mounted on one side from which pivotly extends an adjustable-length draw hook which interlocks with said complimentary shaped second part or latch hook that is mounted on the opposite side, said bracket also incorporating a rotatable lever with which to control said draw hook, whereby adjustable panel stress can be generated.

26. The article of storage furniture according to claim 23 wherein said engagement contracting means comprises a roller reefing device within said framework, said reefing device comprises an elongated, cylindrically shaped member or roller that is rotatable about its longitudinal axis, said roller having a longitudinal slot to insertably engage said panel, said forcing means rotates said roller until said engaged panel is effectively stressed.

27. The article of storage furniture according to claim 1 wherein said tensioning means comprises a gravity-induced stressing means for stressing said storage system at least vertically, said framework being at least vertically dimensionally fixed, said storage system having only a traveling engagement at least below the uppermost plane of engagement, whereby the downward gravitational pull of static and dynamic loads on said storage system allow said traveling engagements to stretch and extend downwards on said upward members for at least vertical stressing of said non-horizontal panels.

28. The article of storage furniture according to claim 27 wherein said upward members are largely vertical, said uppermost plane of engagement is fixed, said storage system further comprises one or more of said optional non-horizontal panels, whereby gravity induces vertical stressing of said non-horizontal panels.

29. The article of storage furniture according to claim 27 wherein said framework is omni-dimensionally fixed, said upward members are sloped outwards from the top of said framework, said uppermost engagement also being traveling, whereby gravity induces said traveling engagements to extend downwards and outwards along said upward members to effectively stress both said horizontal and non-horizontal panels.

30. The article of storage furniture according to claim 1 wherein said tensioning means comprises a panel shrinking means for dimensional reduction of said storage system after engagement to said framework, said panel material further being substantially permanently shrinkable, said shrinking means comprising at least one shrinkage-inducing agent to activate the shrinking process of said panels.

31. The article of storage furniture according to claim 1 wherein said tensioning means comprises a panel prestressing means for effective stressing of said storage system before engagement to said framework, whereby said engaging means locks and maintains the prestressed tension.

32. The article of storage furniture according to claim 1 wherein said tensioning means comprises a combination of at least two of the following means: a framework expanding means, an engagement contracting means, a gravity-induced stressing means, a panel shrinking means and a panel prestressing means for collectively generating continuous and adjustable tensile stress to said panels in at least two largely perpendicular directions.

33. The article of storage furniture according to claim 1 wherein said storage system further comprises a load redistribution means for interconnecting the lesser load-bearing points with the greater load-bearing points of said storage system, said load redistribution means comprising a flexible, tensilely strong and substantially inelastic material such that when effectively tensilely stressed allows static and dynamic loads to be effectively redistributed and transferred to said engaged framework whereby overall panel load-bearing capacity is increased and rigidity is enhanced.

34. The article of storage furniture according to claim 33 wherein said load redistribution means is situated within the plane of said panels and comprises a plurality of elongated fibers.

35. The article of storage furniture according to claim 34 wherein said intrapanel load redistribution means is situated within at least said horizontal panels and comprises a linear fixed suspension means for establishing a broad-based suspension network comprising a plurality of said elongated fibers that radially emanate from said greater load-bearing points, said fibers criss-crossing said panel plane converging and attaching with each other forming a plurality of fixed fiber intersection points such that each is fixedly tethered to three or more distinct of said greater load-bearing points and the convergence angles at said fixed points are not greater than 180°, said network optionally further comprising one or more fiber bridges between two opposing dual-tethered points to form additional of said fixed points.

36. The article of storage furniture according to claim 34 wherein said intrapanel load redistribution means is situated within the optional vertical panels of said storage system and comprises a linear v-suspension means for establishing a broad-based suspension network comprising a plurality of said elongated fibers that emanate downwards from said greater load-bearing points, said fibers criss-crossing said panel plane converging and attaching with each other forming a plurality of stabilized fiber intersection points such that each is stably tethered to two distinct of said greater load-bearing points and the upper convergence angle at said stabilized points is less than 180°.

37. The article of storage furniture according to claim 33 wherein said load redistribution means extends between said lesser load-bearing points on and said greater load-bearing points outside the plane of said panel, said load redistributing means further comprising a plurality of elongated fibers.

38. The article of storage furniture according to claim 37 wherein said extrapanel load redistribution means comprises a planar v-suspension means for establishing a stabilized y-network comprising two sloped panels, of said optional non-horizontal panels, that converge and interconnect along a stabilized line, the upper convergence angle at said stabilized line being less than 180°, the opposite ends of said sloped panels being engaged by at least their corners to said framework, said y-network further comprising an interior vertical panel suspended from said stabilized line and attaching to the underlying shelves.

39. The article of storage furniture according to claim 37 wherein said extrapanel load redistribution means comprises a planar fixed-suspension means for establishing a fixed network comprising at least three of said panels, the exterior ends of which being engaged by at least their corners to said framework, said panels converging and interconnecting along a common fixed line such that all the convergence angles at said fixed line are no greater than 180°, said fixed network further comprising an interior vertical panel suspended from said fixed line and attaching to the underlying shelves.

40. The article of storage furniture according to claim 37 wherein said extrapanel load redistribution means comprises a triangular-shaped, largely vertically oriented suspension brace having three borders, a horizontal border, an upwardly disposed border and a diagonal border, said upward border being engaged to said framework's upward member upwards from the engagement point of said shelf, said horizontal border being attached to said shelf from the engaged corner along a line of lesser load-bearing points.

41. The article of storage furniture according to claim 1 wherein said furniture further comprises a stiffening means for reinforcing said panels, said stiffening means comprising increasingly less flexible and more rigid material to achieve ever diminishing returns of enhanced load-bearing capacity and rigidity of said storage system.

42. An article of storage furniture comprising in combination:

a framework comprising a plurality of interconnected support members including at least one largely horizontal support member and at least one upwardly disposed support member, the configuration of said interconnected support members defining at least four generally planar faces comprising one largely horizontal face to serve as a base and at least three upwardly disposed faces, adjacent faces forming a plurality of structural edges and a plurality of imaginary edges, the horizontal cross-section of said upward members above said base having less than three nonlinear points;

a three-dimensional storage system or grid comprising a plurality of panels including a plurality of non-horizontal panels that at least have a border that extends along said imaginary edges which are sloped, said storage grid further comprising a plurality of largely horizontal panels that are at least attached to said non-horizontal panels and optionally engaged to said support members, said upward panels being engaged to said support members, said storage grid being composed of flexible, tensilely strong and substantially inelastic material, said storage grid optionally having a flexible load redistribution means for increasing load-bearing capacity and rigidity, the overall shape of said storage grid being dimensionally compatible with said framework;

means for engaging said storage grid to said framework such that said grid is compatibly aligned, suspended and integrated with said framework;

tensioning means for generating continuous tensile stress in at least two largely perpendicular directions so as to remove the slack and the initial elasticity of said grid's panels, whereby said article of storage furniture provides "near-rigid" storage space under anticipated static and dynamic loads placed thereon.

43. The article of storage furniture according to claim 42 wherein said framework comprises three support members that are elongated, adjustably telescoping and converging to interconnect at a 3-way right angle, said storage grid engaged to the ends of said support members and said right angle, said tensioning means comprises a framework expanding means to elongate said telescoping members, a forcing means to activate said elongation and a locking means to maintain the expanded dimension.

44. An article of storage furniture comprising in combination:

a framework comprising a plurality of interconnected support members including at least one largely horizontal support member and a plurality of upwardly disposed support members, the configuration of said interconnected support members defining at least four generally planar faces comprising at least one largely horizontal face to serve as a base and at least three upwardly disposed faces, said planar faces collectively encompassing a largely uninterrupted interior chamber;

a storage system comprising a plurality of panels including a plurality of horizontal panels or shelves and optionally one or more non-horizontal panels that interconnect said shelves, the material of said panels being flexible, tensilely strong and substantially inelastic, said storage system optionally having a flexible load redistribution means for increasing load-bearing capacity and rigidity, the overall shape of said storage system being dimensionally compatible with said framework, said storage system's panels being tensilely prestressed, before engagement to said framework, in at least two largely perpendicular directions so as to remove the slack and the initial elasticity;

means for engaging said prestressed storage system to said framework such that said system is compatibly aligned and suspended with said framework, said engaging means being capable of substantially maintaining the tensile stress of said prestressed storage system, whereby said article of storage furniture provides "near-rigid" storage space under anticipated static and dynamic loads thereon placed.

45. The article of storage furniture according to claim 3 wherein said locking means comprises a rigid strut member of suitable length inserted between opposing of said outwardly direct placed members, said locking means further comprising a fixing means for immobilizing said inserted strut members, thereby effectively maintaining the desired stress of said engaged storage system.

46. The article of storage furniture according to claim 45 wherein said framework comprises two of said upwardly disposed members which are largely vertical and planar to serve as opposing side walls, said storage system being prestressed in a fore-aft direction and fixedly engaged to said opposing vertical side walls, said framework further comprising two or more of said largely horizontal support members which are furthermore largely planar and also serve as said strut members between said vertical side walls, the inside faces of said vertical side walls having a channeling means of compatibly receiving and holding the exterior ends of said horizontal members.

47. The article of storage furniture according to claim 45 wherein said framework comprises four of said upwardly disposed support members which are elongated and largely vertical to serve as corner supports, said storage system further comprising four or more of said largely horizontal support members which are elongated and serve as said strut members between said vertical corner supports.

48. The article of storage furniture according to claim 45 wherein said strut members are furthermore elongatable, thereby providing adjustability to the tensioning of said engaged storage system.

49. An article of storage furniture comprising in combination:

a framework comprising a plurality of interconnected support members including at least two largely vertical support members and at least two largely horizontal support members, the configuration of said interconnected support members defining at least six generally planar faces;

a storage system comprising a plurality of sloped panels and optionally one or more vertical panels and optionally one or more horizontal panels or shelves, at least two of said sloped panels being of opposing slopes, the ends of said two opposing sloped panels being fixedly engaged to either said framework or to a plurality of fixed suspension lines or to a combination thereof, the material of said panels being flexible, tensilely strong and substantially inelastic, the overall shape of said storage system being dimensionally compatible with said framework;

means for engaging said system to said framework wherein said system is compatibly aligned, suspended and effectively integrated with said framework, said engaging means comprising at least two complimentary interlocking parts, a first part that is connected to said framework and a second part that is connected to said panel;

tensioning means for generating continuous tensile stress in at least two largely perpendicular directions so as to remove the slack and the initial elasticity of said system's panels, whereby said article of storage furniture is substantially free of parallelism movement and provides "near-rigid" storage space under anticipated static and dynamic loads thereon placed.

50. The article of storage furniture according to claim 49 wherein a plurality of said sloped panels converge at one or more fixed suspension lines such that the upper convergence angle at said fixed suspension lines is at or near 90 degrees, whereby standing rectangular items can be stored effectively in the upper quadrant without bookends.

51. The article of storage furniture according to claim 49 wherein said storage system is engaged exclusively to said largely vertical support members.

52. The article of storage furniture according to claim 49 wherein said storage system is engaged exclusively to said largely horizontal support members.

* * * * *